US009552910B2

(12) United States Patent
Kang et al.

(10) Patent No.: US 9,552,910 B2
(45) Date of Patent: Jan. 24, 2017

(54) FERRITE MAGNET WITH SALT AND MANUFACTURING METHOD OF THE SAME

(71) Applicants: LG ELECTRONICS INC., Seoul (KR); Industry-University Cooperation Foundation Hanyang University ERICA Campus, Ansan-si, Gyeonggi-do (KR)

(72) Inventors: Namseok Kang, Seoul (KR); Jinbae Kim, Seoul (KR); Yongho Choa, Ansan-si (KR); Jongyoul Kim, Ansan-si (KR); Gukhwan An, Ansan-si (KR); Sanggeun Cho, Ansan-si (KR)

(73) Assignees: LG ELECTRONICS INC., Seoul (KR); INDUSTRY-UNIVERSITY COOPERATION FOUNDATION HANYANG UNIVERSITY ERICA CAMPUS, Ansan-si (KR)

( * ) Notice: Subject to any disclaimer, the term of this patent is extended or adjusted under 35 U.S.C. 154(b) by 673 days.

(21) Appl. No.: 13/962,130

(22) Filed: Aug. 8, 2013

(65) Prior Publication Data

US 2014/0070130 A1 Mar. 13, 2014

(30) Foreign Application Priority Data

Sep. 12, 2012 (KR) ..... 10-2012-0101249

(51) Int. Cl.

| | |
|---|---|
| ***H01F 1/01*** | (2006.01) |
| ***H01F 1/37*** | (2006.01) |
| ***H01F 1/113*** | (2006.01) |

(52) U.S. Cl.

CPC ..... *H01F 1/01* (2013.01); *H01F 1/113* (2013.01); *H01F 1/37* (2013.01)

(58) Field of Classification Search

CPC ..... H01F 1/113; H01F 1/37

See application file for complete search history.

(56) References Cited

U.S. PATENT DOCUMENTS 3,527,706 A * 9/1970 Weiland ..... C04B 35/2683 252/62.55

4,401,643 A 8/1983 Hibst et al.

FOREIGN PATENT DOCUMENTS

CN 1378996 A 11/2002
CN 1167088 C 9/2004

(Continued)

OTHER PUBLICATIONS

An et al., "Fabrication and characterization of a hydroxyapatite nanopowder by ultrasonic spray pyrolysis with salt-assisted decomposition," Materials Science and Engineering A, vol. 449-451, 2007, pp. 821-824.

(Continued)

*Primary Examiner* — Carol M Koslow

(74) *Attorney, Agent, or Firm* — Birch, Stewart, Kolasch & Birch, LLP

(57) ABSTRACT

A ferrite magnet with salt includes 40 to 99.9 weight % of ferrite and 0.1 to 60 weight % of salt, wherein the salt has a melting point lower than a synthetic temperature of the ferrite, and the salt is melted to form a matrix between the ferrite particles, and a manufacturing thereof. The ferrite magnet with salt has advantages in terms of process conditions due to fast synthesis reaction at low temperatures compared to typical magnets, easily obtaining nano-sized particles having high crystallinity, preventing cohesion between particles and particle growth by molten salt, allowing sintering at temperatures lower than typical during the molding and sintering processes for producing a ferrite magnet with salt due to synthesized ferrite magnetic powder with salt thus preventing the deterioration of magnetic (Continued)

characteristics due to particle growth, and allowing alignment in the direction of magnetization easy axis to obtain higher magnetic characteristics.

15 Claims, 38 Drawing Sheets

(56) References Cited

FOREIGN PATENT DOCUMENTS

| | | | | |
|---|---|---|---|---|
| CN | 101168452 | | * | 4/2008 |
| CN | 101168452 | A | | 4/2008 |
| CN | 102010188 | A | | 4/2011 |
| CN | 102260072 | A | | 11/2011 |
| CN | 102311261 | A | | 1/2012 |
| EP | 1090884 | A1 | | 4/2001 |
| KR | 10-2005-0103164 | A | | 10/2005 |
| KR | 10-0554500 | B1 | | 2/2006 |

OTHER PUBLICATIONS

Inukai et al., "Synthesis and hyperthermia property of hydroxyapatite-ferrite hybrid particles by ultrasonic spray pyrolysis," Journal of Magnetism and Magnetic Materials, vol. 323, 2011 (Available online Nov. 26, 2010), pp. 965-969.

Kim et al., "Nanosized barium ferrite powders prepared by spray pyrolysis from citric acid solution," Ceramics International, vol. 35, 2009 (Available online Nov. 17, 2008), pp. 1933-1937.

Lee et al., "Preparation of Unsintered Spherical BaFe12O19 Nanoparticles via an Alcohol-Assisted Spray-Pyrolysis Route," Journal of the American Ceramic Society, vol. 91, No. 9, Sep. 2008, pp. 2856-2861.

Machine Translation of CN 101168452.

Machine Translation of KR 10-2005-0103164.

* cited by examiner

| | In plane | Out of plane |
|---|---|---|
| Ms | 59.436 | 53.986 |
| Mr | 32.397 | 30.634 |
| Hc | 4954 | 5001 |
| Mr/Ms | 54.51% | 56.74% |

| | In plane | Out of plane |
|---|---|---|
| Ms | 57.930 | 58.573 |
| Mr | 31.407 | 33.902 |
| Hc | 4562 | 4738 |
| Mr/Ms | 54.22% | 56.75% |

| | In plane | Out of plane |
|---|---|---|
| Ms | 62.131 | 53.372 |
| Mr | 32.747 | 32.811 |
| Hc | 4803 | 4859 |
| Mr/Ms | 52.71% | 61.48% |

FERRITE MAGNET WITH SALT AND MANUFACTURING METHOD OF THE SAME

RELATED APPLICATION

This application claims the benefit of Korean Patent Application No. 10-2012-0101249, filed on Sep. 12, 2012, which is hereby incorporated by reference for all purposes as if fully set forth herein.

BACKGROUND

1. Field

The following descriptions relates to a ferrite magnet and a manufacturing method thereof.

2. Background

Soft ferrite refers to a material in which the speed of magnetization is fast even with a slight magnetic field to suddenly saturate the magnetization of the material and also erasing or inverting residual magnetization can be sufficiently accomplished even with a weak magnetic field, and due to such characteristics it is mostly used for devices for filtering or amplifying signals.

Hard ferrite typically refers to a permanent magnet made of ferrite, which has a lot of applications because a strong magnetic field in an inverse direction is required while not requiring voltage application even when removing or inverting residual magnetization, and a constant magnetic field can be generated while not generating heat in itself.

The application of ferrite are made through molding and sintering, and have been used in the broad fields in the aspect of allowing various shapes and requiring a low cost.

Soft ferrite has been used for deflection yokes (DYs) and fly back transformers (FBTs) which are components for Braun tube to enhance the function of electronic deflection and power supply devices. In recent years, soft ferrite has been mostly used in the fields of IMT related communication cores and electromagnetic interference (EMI) cores for absorbing electromagnetic waves and removing noises in addition to home appliance industries such as flat televisions (TVs), digital televisions (TVs), and the like.

Hard ferrite is mostly applicable to electromechanical energy conversions such as a speaker, a permanent magnet motor, a moving coil type device, a magnetic generator, microphone, and the like, and also used for a storage media, and the like.

In order to apply such a ferrite magnet to various fields, it is important to obtain fine single domain powder having an excellent dispersibility.

There has been an attempt for obtaining fine single crystalline ferrite magnetic powder by adding salt, a technology for adding a large amount of sodium chloride or potassium chloride on the basis of a solid state reaction method to synthesize barium ferrite (Ba-ferrite) has been disclosed in the Korean Patent Registration No. 10-0554500.

The foregoing method may include the processes of mixing a raw material with salt according to the objective material and characteristic to correspond to a stoichiometric ratio so as to synthesize ferrite precursor powder, and performing a heat treatment for crystallization and then removing salt.

According to the foregoing method, it may be possible to produce small particles less than 100 nm, but the cohesion of particles may easily occur due to the characteristics of ferrite magnetic particles during the process of removing salt.

Furthermore, even though fine particles are produced through the above complicated process, it may be impossible to prevent particle growth during the sintering process. The problems due to the manufacturing method may cause an increase of the process cost as well as the deterioration of magnetic characteristics.

Sodium chloride or potassium chloride may be added to attempt a ferrite magnetic powder synthesis to obtain fine particles, but the molding and sintering processes are carried out subsequent to removing molten salt to form magnets, and thus there still remain problems in that it is difficult to suppress the growth of ferrite magnetic particles, and also the alignment of magnetic nanoparticles required to maximize magnetization cannot be easily achieved.

SUMMARY

A purpose is to provide a ferrite magnet with salt having a high saturated magnetization and coercive force and having a low cohesion between ferrite particles in order to solve the foregoing problems.

Another purpose is to provide a method of manufacturing a ferrite magnet with salt, having advantages in terms of process conditions due to fast synthesis reaction at low temperatures compared to typical magnets, easily obtaining nano-sized particles having high crystallinity, preventing cohesion between particles and particle growth by molten salt, allowing sintering at temperatures lower than typical during the molding and sintering processes for producing a ferrite magnet with salt due to synthesized ferrite magnetic powder with salt thus preventing the deterioration of magnetic characteristics due to particle growth, and allowing alignment in the direction of magnetization easy axis to obtain higher magnetic characteristics.

BRIEF DESCRIPTION OF THE DRAWINGS

The accompanying drawings, which are included to provide a further understanding and are incorporated in and constitute a part of this specification, illustrate examples.

In the drawings.

DETAILED DESCRIPTION

Figure 1:
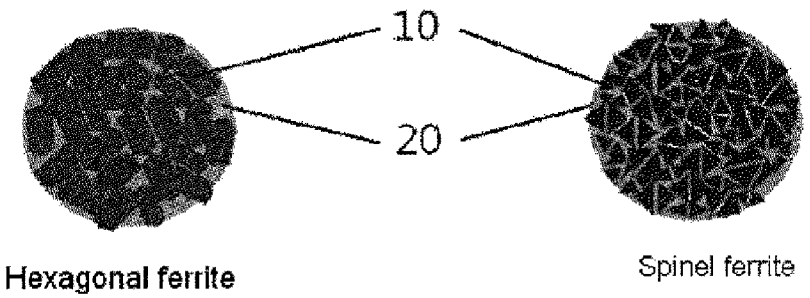
FIG. 1 is a schematic diagram illustrating ferrite magnetic powder with salt.

There is provided a ferrite magnet with salt containing 40 to 99.9 weight % of ferrite and 0.1 to 60 weight % of salt, wherein the salt has a melting point lower than a synthetic temperature of the ferrite, and the salt is melted to form a matrix between the ferrite particles.

The ferrite magnet with salt may have a structure in which a plurality of ferrites are uniformly dispersed in salt, and the ferrite may be formed of secondary particles, and the second particles may have a form in which a plurality of primary particles having a size smaller than that of the secondary particles are conglomerated along with salt.

The secondary particles may be formed of spherical particles having a diameter of 0.1 to 20 μm or non-spherical particles having a size of 0.1 to 1000 μm, and the primary particles are formed of a size of 5 to 1000 nm.

The ferrite magnet with salt may have a ratio (Mr/Ms) of residual magnetization (Mr) to saturated magnetization (Ms) greater than 50%.

The salt may be comprised of at least one or more kinds of salts selected from a chloride metal salt, a nitric acid metal salt, and a sulfuric acid metal salt, and the chloride metal salt may be one or more kinds of salts selected from NaCl, KCl, LiCl, $CaCl_2$ and $MgCl_2$, and the nitric acid metal salt may be one or more kinds of salts selected from $NaNO_3$, $KNO_3$, $LiNO_3$, $Ca(NO_3)_2$ and $Mg(NO_3)_2$, and the sulfuric acid metal salt may be one or more kinds of salts selected from $Na_2SO_4$, $K_2SO_4$, $Li_2SO_4$, $CaSO_4$ and $MgSO_4$.

The ferrite may be a hexagonal ferrite, and the hexagonal ferrite may have a form of $MFe_{12}O_{19}$, and the M may be comprised of one or more kinds of elements selected from Ba, Sr and La.

The ferrite may be a spinel ferrite, and the spinel ferrite may have a form of $MFe_2O_4$ or $M_2FeO_4$, and the M may be one or more kinds of elements selected from Co, Mg, Mn, Zn and Ni.

Furthermore, there is provided a method of manufacturing a ferrite magnet with salt, and the method may include preparing a source material of the ferrite to be synthesized, preparing a salt having a melting point lower than a synthetic temperature of the ferrite to be synthesized, mixing the source material of the ferrite with the salt, synthesizing ferrite magnetic powder with salt while melting the salt, and molding and sintering the ferrite magnetic powder with salt into a desired form to obtain a ferrite magnet with salt, wherein the ferrite magnet with salt comprises 40 to 99.9 weight % of ferrite and 0.1 to 60 weight % of salt, and the salt is melted to form a matrix between the ferrite particles.

The salt may preferably use a salt having a melting point lower than the temperature of synthesizing the ferrite magnetic powder with salt, and the sintering may be preferably carried out in a temperature condition of melting the salt or a temperature and pressure condition of melting the salt.

The ferrite magnet with salt may have a structure in which a plurality of ferrites are uniformly dispersed in salt, and the ferrite may be formed of secondary particles, and the second particles may have a form in which a plurality of primary particles having a size smaller than that of the secondary particles are conglomerated along with salt.

The secondary particles may be formed of spherical particles having a diameter of 0.1 to 20 μm or non-spherical particles having a size of 0.1 to 1000 μm, and the primary particles may be formed of a size of 5 to 1000 nm.

The ferrite magnet with salt may have a ratio (Mr/Ms) of residual magnetization (Mr) to saturated magnetization (Ms) greater than 50%.

The salt may be comprised of at least one or more kinds of salts selected from a chloride metal salt, a nitric acid metal salt, and a sulfuric acid metal salt, and the chloride metal salt may be one or more kinds of salts selected from NaCl, KCl, LiCl, CaCl2 and MgCl2, and the nitric acid metal salt may be one or more kinds of salts selected from NaNO3, KNO3, LiNO3, Ca(NO3)2 and Mg(NO3)2, and the sulfuric acid metal salt may be one or more kinds of salts selected from Na2SO4, K2SO4, Li2SO4, CaSO4 and MgSO4.

The source material of the ferrite may be comprised of one or more kinds of materials selected from $Ba(NO_3)_2$, $BaCO_3$, $BaCl_2$, $BaSO_4$, $BaO_2$, $Sr(NO_3)_2$, $SrCO_3$, $SrCl_2$, $SrSO_4$, $Sr(OH)_2La(NO_3)_3$, $LaCl_3La_2(SO_4)_3$ and $La(OH)_3$ and one or more kinds of materials selected from $Fe(NO_3)_3$, $FeCO_3$, $FeCl_3$, $Fe_2O_3$, $FeCl_2$ and $Fe(OH)_3$, and the ferrite may be a hexagonal ferrite, and the hexagonal ferrite may have a form of $MFe_{12}O_{19}$, and the M may be comprised of one or more kinds of elements selected from Ba, Sr and La.

The source material of the ferrite may be comprised of one or more kinds of materials selected from $Fe(NO_3)_3$, $FeCO_3$, $FeCl_3$, $Fe_2O_3$, $FeCl_2$, $Fe(OH)_3$, $Co(NO_3)_2$, $CoCO_3$, $CoCl_2$, $CoSO_4$, $Mn(NO_3)_2$, $MnCO_3$, $MnCl_2$, $MnSO_4$, $MnO_2$, $Mg(NO_3)_2$, $MgCO_3$, $MgCl_2$, $MgSO_4$, $Ni(NO_3)_2$, $NiCO_3$, $NiCl_2$, $NiSO_4$, $Zn(NO_3)_2$, $ZnCl_2$, $ZnSO_4$ and ZnO, and the ferrite may be a spinel ferrite, and the spinel ferrite may have a form of $MFe_2O_4$ or $M_2FeO_4$, and the M may be one or more kinds of elements selected from Fe, Co, Mg, Mn, Zn and Ni.

The source material of the ferrite may be comprised of one or more kinds of materials selected from $Ba(NO_3)_2$, $BaCO_3$, $BaCl_2$, $BaSO_4$, $BaO_2$, $Sr(NO_3)_2$, $SrCO_3$, $SrCl_2$, $SrSO_4$, $Sr(OH)_2La(NO_3)_3$, $LaCl_3La_2(SO_4)_3$ and $La(OH)_3$ and one or more kinds of materials selected from $Fe(NO_3)_3$, $FeCO_3$, $FeCl_3$, $Fe_2O_3$, $FeCl_2$, $Fe(OH)_3$, $Co(NO_3)_2$, $CoCO_3$, $CoCl_2$ and $CoSO_4$, and said synthesizing the ferrite magnetic powder with salt may include supplying power to a heating means surrounding the circumference of a reaction chamber in a spray pyrolysis apparatus and heating the reaction chamber to maintain a temperature higher than the melting point of the salt in a consistent manner, supplying a carrier gas to a sprayer containing a mixture of the source material of the ferrite and the salt, vibrating the mixture contained in the sprayer by an ultrasonic transducer to generate liquid droplets in the sprayer, and introducing the liquid droplets into the reaction chamber by the carrier gas and allowing the liquid droplets introduced into the reaction chamber to be subjected to the pyrolysis and oxidation reaction to synthesize ferrite magnetic powder with salt.

There is provided a method of manufacturing a ferrite magnet with salt, having advantages in terms of process conditions due to fast synthesis reaction at low temperatures compared to typical magnets, easily obtaining nano-sized particles having high crystallinity, preventing cohesion between particles and particle growth by molten salt, allowing sintering at temperatures lower than typical during the molding and sintering processes for producing a ferrite magnet with salt due to synthesized ferrite magnetic powder with salt thus preventing the deterioration of magnetic characteristics due to particle growth, and allowing alignment in the direction of magnetization easy axis to obtain higher magnetic characteristics.

It may have advantages in that the synthesis of ferrite magnetic powder is carried out within a melting point to apply a liquid phase sintering mechanism, and the diffusion speed of particles is far superior to the synthesis in a typical solid phase to further expedite the speed of synthesis, and high crystalline power can be obtained at lower temperatures as well as cohesion between magnetic particles can be prevented within a melting point.

Furthermore, the alignment of magnetic particles may be induced during the sintering process due to the security of fluidity by residual salt, thus exhibiting higher magnetic characteristics.

Furthermore, there exists a disadvantage that the existing sintering process is carried out at temperatures higher than those at which the particle growth of ferrites occurs, thereby affecting the magnetic characteristics. However, there is an advantage that sintering is possible at temperatures at which the particle growth of ferrites does not occur (for instance, at the salt melting temperature or temperatures higher than that), thereby not affecting the magnetic characteristics of a ferrite magnet.

A ferrite magnet with salt may be applicable to all types of electronic devices and components that use soft or hard ferrite magnets.

Hereinafter, exemplary preferred embodiments will be described in detail with reference to the accompanying drawings. However, it should be understood that the following embodiments will be provided to allow those skilled in the art to fully understand the invention, but the invention may not be necessarily limited to embodiments described below, and various modifications can be made within the scope of the present invention.

A ferrite magnet with salt may contain 40 to 99.9 weight % of ferrite and 0.1 to 60 weight % of salt, wherein the salt has a melting point lower than a synthetic temperature of the ferrite, and the salt is melted to form a matrix between the ferrite particles. It is preferable that a ferrite magnet with salt contains 40 to 99.9 weight %, more preferably 65 to 99.9 weight % of the ferrite, and contains 0.1 to 60 weight %, more preferably 0.1 to 35 weight % of the salt.

The ferrite magnet with salt may have a structure in which a plurality of ferrites are uniformly dispersed in salt, and the ferrite may be formed of secondary particles, and the second particles may have a form in which a plurality of primary particles having a size smaller than that of the secondary particles are conglomerated along with salt.

The secondary particles may be formed of spherical particles having a diameter of 0.1 to 20 μm, and the primary particles are formed of a size of 5 to 1000 nm. The secondary particles may be formed of non-spherical particles having a size of 0.1 to 1000 μm. The primary particles may be formed of hexagonal plate shaped or rod shaped particles.

The ferrite magnet with salt has a ratio (Mr/Ms) of residual magnetization (Mr) to saturated magnetization (Ms) greater than 50%. The Mr/Ms value may be greater than 50%, for example, greater than 50% but less than 99.9%.

The salt may be comprised of at least one or more kinds of salts selected from a chloride metal salt, a nitric acid metal salt, and a sulfuric acid metal salt, and the chloride metal salt may be one or more kinds of salts selected from NaCl, KCl, LiCl, $CaCl_2$ and $MgCl_2$, and the nitric acid metal salt may be one or more kinds of salts selected from $NaNO_3$, $KNO_3$, $LiNO_3$, $Ca(NO_3)_2$ and $Mg(NO_3)_2$, and the sulfuric acid metal salt may be one or more kinds of salts selected from $Na_2SO_4$, $K_2SO_4$, $Li_2SO_4$, $CaSO_4$ and $MgSO_4$.

The ferrite may be a hexagonal ferrite, and the hexagonal ferrite may have a form of $MFe_{12}O_{19}$, and the M may be comprised of one or more kinds of elements selected from Ba, Sr and La.

The ferrite may be a spinel ferrite, and the spinel ferrite may have a form of $MFe_2O_4$ or $M_2FeO_4$, and the M may be one or more kinds of elements selected from Co, Mg, Mn, Zn and Ni.

A method of manufacturing a ferrite magnet with salt may include preparing a source material of the ferrite to be synthesized, preparing a salt having a melting point lower than a synthetic temperature of the ferrite to be synthesized, mixing the source material of the ferrite with the salt, synthesizing ferrite magnetic powder with salt while melting the salt, and molding and sintering the ferrite magnetic powder with salt into a desired form to obtain a ferrite magnet with salt, wherein the ferrite magnet with salt contains 40 to 99.9 weight % of ferrite and 0.1 to 60 weight % of salt, and the salt is melted to form a matrix between the ferrite particles.

Hereinafter, a synthetic temperature of the ferrite is used to denote a temperature of synthesizing ferrite magnetic powder. Various methods such as spray pyrolysis method may be used for the synthesis of ferrite magnetic powder, and for example, the synthetic temperature of the ferrite in case of using the spray pyrolysis method is a temperature at which liquid droplets are passed through a reaction chamber to synthesize ferrite magnetic powder, denoting the highest temperature between the inlet and outlet temperatures of the reaction chamber.

The salt may preferably use a salt having a melting point lower than the temperature of synthesizing the ferrite magnetic powder with salt, and the sintering may be preferably carried out in a temperature condition of melting the salt or a temperature and pressure condition of melting the salt. The sintering may be preferably carried out at temperatures higher than the melting point (800° C. in case of NaCl, 776° C. in case of KCl) of the salt when it is not pressurized during the sintering, and the melting of salt can be carried out even at temperatures lower than the melting point of the salt when it is pressurized during the sintering. The pressurization during the sintering may be preferably carried out in the range of 20 to 200 MPa.

The salt may be comprised of at least one or more kinds of salts selected from a chloride metal salt, a nitric acid metal salt, and a sulfuric acid metal salt, and the chloride metal salt may be one or more kinds of salts selected from NaCl, KCl, LiCl, $CaCl_2$ and $MgCl_2$, and the nitric acid metal salt may be one or more kinds of salts selected from $NaNO_3$, $KNO_3$, $LiNO_3$, $Ca(NO_3)_2$ and $Mg(NO_3)_2$, and the sulfuric acid metal salt may be one or more kinds of salts selected from $Na_2SO_4$, $K_2SO_4$, $Li_2SO_4$, $CaSO_4$ and $MgSO_4$.

The salt that can exist in a liquid state at a sintering condition (sintering temperature and pressure) of ferrite along with a source material of ferrite may be added to induce that a ferrite magnet can be synthesized in liquefied salt during the sintering, and molten salt may be used as it is without washing prior to sintering.

It may have advantages in that the synthesis of ferrite magnetic powder is carried out within a melting point to apply a liquid phase sintering mechanism, and the diffusion speed of particles is far superior to the synthesis in a typical solid phase to further expedite the speed of synthesis, and high crystalline power can be obtained at lower temperatures as well as cohesion between magnetic particles can be prevented within a melting point.

Furthermore, the alignment of magnetic particles may be induced during the sintering process due to the security of fluidity by residual salt, thus exhibiting higher magnetic characteristics.

Furthermore, there exists a disadvantage that the existing sintering process is carried out at temperatures higher than those at which the particle growth of ferrites occurs, thereby affecting the magnetic characteristics. However, there is an advantage that sintering is possible at temperatures at which the particle growth of ferrites does not occur (for instance, at the salt melting temperature or temperatures higher than that), thereby not affecting the magnetic characteristics of a ferrite magnet.

The ferrite magnetic powder with salt is synthesized and then the ferrite magnetic powder with salt is molded and sintered as it is without washing and removing the salt to synthesize a ferrite magnet with salt and molten salt is used as it is for the magnet.

Methods that can be used to obtain ferrite magnetic powder may include a solid state reaction method, a coprecipitation method, a sol-gel method, a glass crystallization method, a hydrothermal method, and an aerosol method.

The solid state reaction method is a method of mixing and pulverizing a starting material along with deionized water at a molar ratio of metal ions and then performing a drying process and then performing a pulverization process again and performing a sintering process to obtain powder.

The coprecipitation method is a method of dissolving a starting material in deionized water at a composition ratio of metal ions to obtain a mixture, and then precipitating the mixture with a precipitant and then repeating the cleaning process, and making a pH adjustment and then performing a filtration and drying process and performing a sintering process to obtain powder.

The sol-gel method is a method of dissolving a starting material in a solvent and then adding an additive to make a sol state solution, and obtaining a powder sample through drying and then performing a sintering process to obtain powder.

The glass crystallization method is a method of mixing a starting material according to a composition ratio of metal ions and then melting the mixture at high temperatures and putting the molten mixture into water to rapidly cool it down to obtain an amorphous material, and sintering the amorphous material for pulverization and then dissolving vitreous components and surplus elements and then performing a sintering process to obtain powder.

The hydrothermal method is a method of placing a starting material into an autoclave to be reacted under temperature and pressure to obtain powder.

The aerosol method is a method of converting starting materials into an aerosol form and producing powder by burning or calcination while passing through a tube furnace.

Various conventional methods for synthesizing ferrite magnetic powder as mentioned above can be used in the manufacture of a ferrite magnet with salt, and thus the selection of the method can be made according to the objective and the characteristics of materials, and the synthesis can be performed without being limited to the kind of ferrite.

For example, the source material of the ferrite may be comprised of one or more kinds of materials selected from $Ba(NO_3)_2$, $BaCO_3$, $BaCl_2$, $BaSO_4$, $BaO_2$, $Sr(NO_3)_2$, $SrCO_3$, $SrCl_2$, $SrSO_4$, $Sr(OH)_2La(NO_3)_3$, $LaCl_3La_2(SO_4)_3$ and $La(OH)_3$ and one or more kinds of materials selected from $Fe(NO_3)_3$, $FeCO_3$, $FeCl_3$, $Fe_2O_3$, $FeCl_2$ and $Fe(OH)_3$, and the ferrite may be a hexagonal ferrite, and the hexagonal ferrite may have a form of $MFe_{12}O_{19}$, and the M may be comprised of one or more kinds of elements selected from Ba, Sr and La.

Furthermore, the source material of the ferrite may be comprised of one or more kinds of materials selected from $Fe(NO_3)_3$, $FeCO_3$, $FeCl_3$, $Fe_2O_3$, $FeCl_2$, $Fe(OH)_3$, $Co(NO_3)_2$, $CoCO_3$, $CoCl_2$, $CoSO_4$, $Mn(NO_3)_2$, $MnCO_3$, $MnCl_2$, $MnSO_4$, $MnO_2$, $Mg(NO_3)_2$, $MgCO_3$, $MgCl_2$, $MgSO_4$, $Ni(NO_3)_2$, $NiCO_3$, $NiCl_2$, $NiSO_4$, $Zn(NO_3)_2$, $ZnCl_2$, $ZnSO_4$ and ZnO, and the ferrite may be a spinel ferrite, and the spinel ferrite may have a form of $MFe_2O_4$ or $M_2FeO_4$, and the M may be one or more kinds of elements selected from Co, Mg, Mn, Zn and Ni.

The method of sintering ferrite magnetic powder with salt may include normal sintering, hot pressing, hot isostatic pressing (HIP), gas pressure sintering (GPS), spark plasma sintering (SPS), and the like, and the selection of the method can be made according to the objective and the characteristics of materials, and the sintering can be performed without being limited to the kind of ferrite.

FIG. 1 is a schematic diagram illustrating ferrite magnetic powder with salt. In FIG. 1, reference numeral "10" represents primary ferrite magnetic particles, reference numeral "20" represents molten salt, and the ferrite magnetic powder with salt is made in the form of a composite powder in which ferrite magnetic particles are distributed on a matrix formed of molten salt without being cohered between particles.

The form of magnetic powder with salt may be used as it is to produce a ferrite magnet with salt. When it is under pressure and temperature condition above the melting point of salt while sintering powder, fluidity due to the melting of residual salt may be increased, thereby inducing an alignment between magnetic particles as well as enhancing the molding density. The alignment of magnetic particles may increase the residual magnetic induction (Br) and coercive force (Hc), thereby enhancing the entire magnetic characteristics.

The source material of the ferrite may be comprised of one or more kinds of materials selected from $Ba(NO_3)_2$, $BaCO_3$, $BaCl_2$, $BaSO_4$, $BaO_2$, $Sr(NO_3)_2$, $SrCO_3$, $SrCl_2$, $SrSO_4$, $Sr(OH)_2La(NO_3)_3$, $LaCl_3La_2(SO_4)_3$ and $La(OH)_3$ and one or more kinds of materials selected from $Fe(NO_3)_3$, $FeCO_3$, $FeCl_3$, $Fe_2O_3$, $FeCl_2$ and $Fe(OH)_3$ and said synthesizing the ferrite magnetic powder with salt may include supplying power to a heating means surrounding the circumference of a reaction chamber in a spray pyrolysis apparatus and heating the reaction chamber to maintain a temperature higher than the melting point of the salt in a consistent manner, supplying a carrier gas to a sprayer containing a mixture of the source material of the ferrite and the salt, vibrating the mixture contained in the sprayer by an ultrasonic transducer to generate liquid droplets in the sprayer, and introducing the liquid droplets into the reaction chamber by the carrier gas and allowing the liquid droplets introduced into the reaction chamber to be subjected to the pyrolysis and oxidation reaction to synthesize ferrite magnetic powder with salt.

Figure 2:
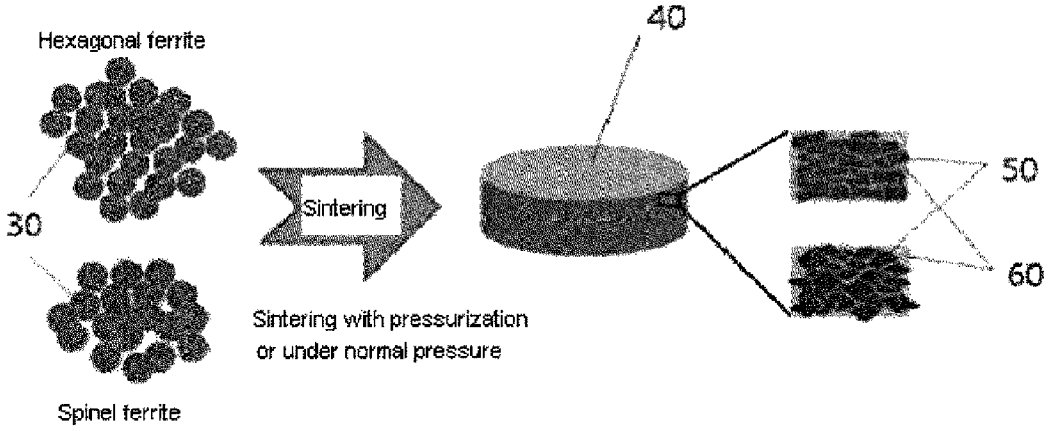
FIG. 2 is a schematic diagram illustrating a process of manufacturing a ferrite magnet with salt.

FIG. 2 is a mimetic diagram illustrating a process of manufacturing a ferrite magnet with salt. In FIG. 2, reference numeral "30" represents ferrite magnetic powder with salt prior to molding, and reference numeral "40" represents a sintered body subsequent to molding and sintering, and a figure at the most left side in FIG. 2 is a drawing illustrating an enlarged minute structure of the sintered body in which reference numerals "50" and "60" represent ferrite magnetic particles and molten salt, respectively. The sintered body illustrates that ferrite magnetic particles are arranged on a molten salt matrix.

The ferrite magnet with salt may have a structure in which a plurality of ferrites are uniformly dispersed in salt, and the ferrite may be formed of secondary particles, and the second particles may have a form in which a plurality of primary particles having a size smaller than that of the secondary particles are conglomerated along with salt. The secondary particles may be formed of spherical particles having a diameter of 0.1 to 20 μm, and the primary particles are formed of a size of 5 to 1000 nm. The secondary particles may be formed of non-spherical particles having a size of 0.1 to 1000 μm. The primary particles may be formed of hexagonal plate shaped or rod shaped particles. The ferrite magnet with salt has a ratio (Mr/Ms) of residual magnetization (Mr) to saturated magnetization (Ms) greater than 50%. The Mr/Ms value may be greater than 50%, for example, greater than 50% but less than 99.9%.

Hereinafter, a case of using a spray pyrolysis method which sprays a liquid precursor among aerosol methods to produce a ferrite magnet with salt is taken as an example, but a method of manufacturing a ferrite magnet with salt may not be necessarily limited to this.

The spray pyrolysis method can synthesize particles at once without using a complicated post thermal treatment within a short period of time, but may cause a problem in which primary particles formed in sprayed liquid droplets are strongly cohered in the form of secondary particles. However, salt may be additionally added, other than the source material of ferrite, thereby preventing cohesion between primary particles and obtaining secondary particles in the form of high crystalline particles being mixed with molten salt.

The barium ferrite ($BaFe_{12}O_{19}$), which is one of ferrite magnets, was produced as an example, and sodium chloride (NaCl) or potassium chloride (KCl) was used for the additionally added salt.

The ferrite magnet may not be necessarily limited to barium ferrite, and also may be spinel ferrite or hexagonal ferrite, and arbitrarily selected for the purpose.

Spinel ferrite has a basic form of $MFe_2O_4$ or $M_2FeO_4$, and a kind of element such as Co, Mg, Mn, Zn, Ni, and the like may be placed or two or more kinds of composite elements thereof may be placed into the site of M. The spinel ferrite may include cobalt ferrite (Co ferrite), nickel ferrite (Ni ferrite), manganese ferrite (Mn ferrite), magnesium ferrite (Mg ferrite), zinc ferrite (Zn ferrite), manganese zinc ferrite (MnZn ferrite), nickel zinc ferrite (NiZn ferrite), and the like.

Hexagonal ferrite has a form of $MFE_{12}O_{19}$, and a kind of element such as Ba, Sr, La, and the like may be placed or two or more kinds of composite elements thereof may be placed into the site of M. The hexagonal ferrite may include barium ferrite (Ba ferrite), strontium ferrite (Sr ferrite), lanthanum ferrite (La ferrite), barium strontium ferrite (BaSr ferrite), barium lanthanum ferrite (BaLa ferrite), strontium lanthanum ferrite (SrLa ferrite), and the like.

A raw material appropriate to each metal element may be used according to the type of ferrite. For source materials of ferrite, the source raw material of barium may be $Ba(NO_3)_2$, $BaCO_3$, $BaCl_2$, $BaSO_4$ or $BaO_2$, and the source raw material of strontium may be $Sr(NO_3)_2$, $SrCO_3$, $SrCl_2$, $SrSO_4$ or $Sr(OH)_2$, and the source raw material of lanthanum may be $La(NO_3)_3$, $LaCl_3La_2(SO_4)_3$ or $La(OH)_3$, and the source raw material of iron may be $Fe(NO_3)_3$, $FeCO_3$, $FeCl_3$, $Fe_2O_3$, $FeCl_2$ or $Fe(OH)_3$, and the source raw material of cobalt may be $Co(NO_3)_2$, $CoCO_3$, $CoCl_2$ or $CoSO_4$, and the source raw material of manganese may be $Mn(NO_3)_2$, $MnCO_3$, $MnCl_2$, $MnSO_4$ or $MnO_2$, and the source raw material of magnesium may be $Mg(NO_3)_2$, $MgCO_3$, $MgCl_2$ or $MgSO_4$, and the source raw material of nickel may be $Ni(NO_3)_2$, $NiCO_3$, $NiCl_2$ or $NiSO_4$, and the source raw material of zinc may be $Zn(NO_3)_2$, $ZnCl_2$, $ZnSO_4$ or ZnO.

The salt may be chloride metal salt (NaCl, KCl, LiCl, $CaCl_2$, $MgCl_2$, etc.), nitric acid metal salt ($NaNO_3$, $KNO_3$, $LiNO_3$, $Ca(NO_3)_2$, $Mg(NO_3)_2$, etc.) or sulfuric acid metal salt ($Na_2SO_4$, $K_2SO_4$, $Li_2SO_4$, $CaSO_4$, $MgSO_4$, etc.), or may be formed in the form of a single or mixed salt, or salt that can exist in a molten state at a sintering temperature may be arbitrarily selected.

The spark plasma sintering (hereinafter, referred to as "SPS") was used to perform a sintering process subsequent to molding synthesized ferrite magnetic powder with salt. The SPS may allow instantaneous heating and cooling using spark plasma with an electro-pressure method using DC pulses among vacuum hot pressings, thereby having an advantage of minimizing the effect on the created crystalline phase.

Hereinafter, exemplary embodiments will be described in detail, but the present invention may not be necessarily limited to the following embodiments.

EXAMPLES

Example 1

$Ba(NO_3)_2$ and $Fe(NO_3)_3.9H_2O$ were used for a source material of barium ferrite. A mixture in which $Ba(NO_3)_2$ and $Fe(NO_3)_3.9H_2O$ are mixed in a molar ratio of 1:12 was used for the source material of barium ferrite. Specifically, $Ba(NO_3)_2$ and $Fe(NO_3)_3.9H_2O$ were added to deionized water and stirred for about an hour to prepare a source material of barium ferrite comprised of $Ba(NO_3)_2$ with a molar concentration of 0.05M and $Fe(NO_3)_3.9H_2O$ with a molar concentration of 0.6M.

Sodium chloride (NaCl) was added to the source material of barium ferrite to prepare a starting material. The sodium chloride was weighed to have a weight ratio of 19% with respect to ferrite magnetic powder with salt (19 weight % with respect to 100 weight % of ferrite magnetic powder with salt) and added.

The starting material was sprayed to form liquid droplets and allowed to pass through a reaction chamber heated at an inlet temperature of about 400° C., and an outlet temperature of about 850° C. along with a carrier gas ($O_2$), thereby synthesizing barium ferrite magnetic powder with salt.

Hereinafter, a method of forming barium ferrite magnetic powder with salt using a spray pyrolysis method will be described in more detail.

Power was supplied to a heating means surrounding the circumference of a reaction chamber in a spray pyrolysis apparatus to heat the reaction chamber so as to maintain an inlet temperature of about 400° C., and an outlet temperature of 850° C.

A carrier gas was supplied to a sprayer containing the starting material. Oxygen gas ($O_2$) was used for the carrier gas. The supply flow rate of the carrier gas was set to about 1.5 l/min.

The starting material contained in the sprayer was vibrated by an ultrasonic transducer to generate liquid droplets in the sprayer, and the liquid droplets were introduced into the reaction chamber by the carrier gas and subjected to the pyrolysis and oxidation reaction to synthesize barium ferrite magnetic powder with sodium chloride. The barium ferrite magnetic powder with sodium chloride formed through the pyrolysis and oxidation reaction was collected by the collector made of a paper filter.

Example 2

A starting material was prepared using a source material of barium ferrite and sodium chloride similarly to the Example 1, but sodium chloride was weighed to have a weight ratio of 31% with respect to ferrite magnetic powder with salt (31 weight % with respect to 100 weight % of ferrite magnetic powder with salt) and added.

The starting material was sprayed to form liquid droplets and allowed to pass through a reaction chamber heated at an inlet temperature of about 400° C., and an outlet temperature of about 850° C. along with a carrier gas ($O_2$) similarly to the Example 1, thereby synthesizing barium ferrite magnetic powder with salt.

Example 3

A starting material was prepared using a source material of barium ferrite and sodium chloride similarly to the Example 1, but sodium chloride was weighed to have a weight ratio of 53% with respect to ferrite magnetic powder with salt (53 weight % with respect to 100 weight % of ferrite magnetic powder with salt) and added.

The starting material was sprayed to form liquid droplets and allowed to pass through a reaction chamber heated at an inlet temperature of about 400° C., and an outlet temperature of about 850° C. along with a carrier gas ($O_2$) similarly to the Example 1, thereby synthesizing barium ferrite magnetic powder with salt.

Figure 3:
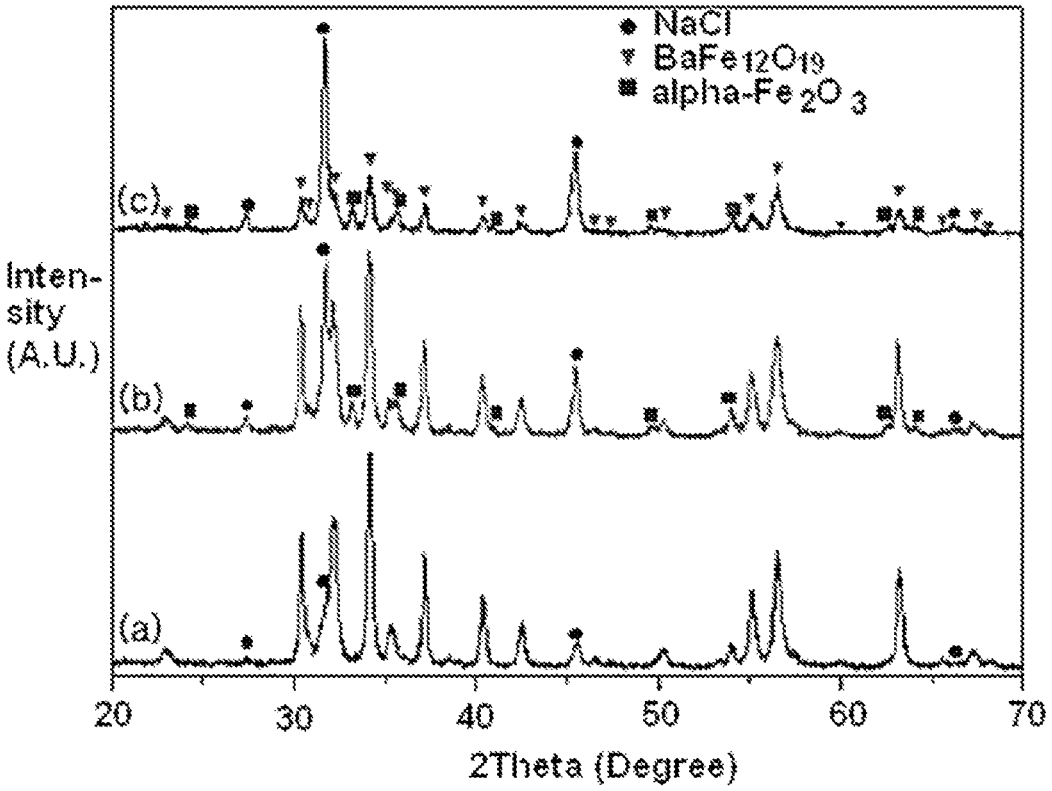
FIG. 3 is a graph illustrating an X-ray diffraction (XRD) pattern of barium ferrite magnetic powder with sodium chloride synthesized according to Examples 1 through 3.

FIG. 3 is a graph illustrating an X-ray diffraction (XRD) pattern of barium ferrite magnetic powder with sodium chloride synthesized according to Examples 1 through 3. FIG. 3A illustrates an X-ray diffraction (XRD) pattern of barium ferrite magnetic powder with sodium chloride synthesized according to Example 1, and FIG. 3B illustrates an X-ray diffraction (XRD) pattern of barium ferrite magnetic powder with sodium chloride synthesized according to Example 2, and FIG. 3C illustrates an X-ray diffraction (XRD) pattern of barium ferrite magnetic powder with sodium chloride synthesized according to Example 3.

Referring to FIG. 3, sodium chloride (NaCl) and barium ferrite ($BaFe_{12}O_{19}$) crystalline phases were shown in all Examples 1 through 3, and hematite ($\alpha$-$Fe_2O_3$) crystalline phases were shown in both Examples 2 and 3. It is shown that the peak of sodium chloride is increased in proportion to the added amount of sodium chloride. Furthermore, when an excessive amount of sodium chloride was added (in case of Examples 2 and 3), hematite ($\alpha$-$Fe_2O_3$) phases were shown, thus indicating that it corresponds to an intermediate phase in the creation of barium ferrite and reaction was not completely carried out. When an excessive amount of sodium chloride is contained, a diffusion path between barium ferrite precursor particles in a molten sodium chloride matrix is lengthened and thus it takes a long reaction time, thereby causing the foregoing results.

Figure 4:
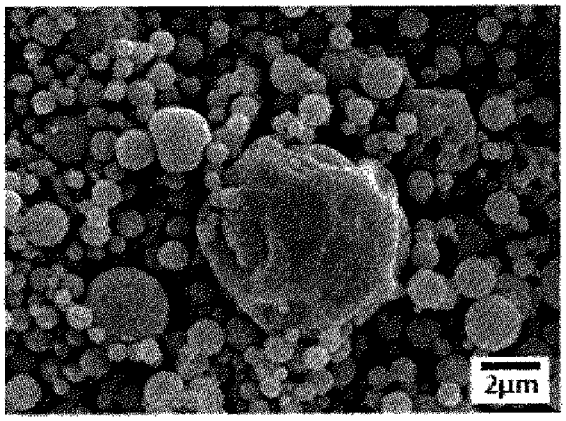
FIGS. 4 and 5 are scanning electron microscope (SEM) photos of barium ferrite magnetic powder with sodium chloride synthesized according to Example 1.
Figure 5:
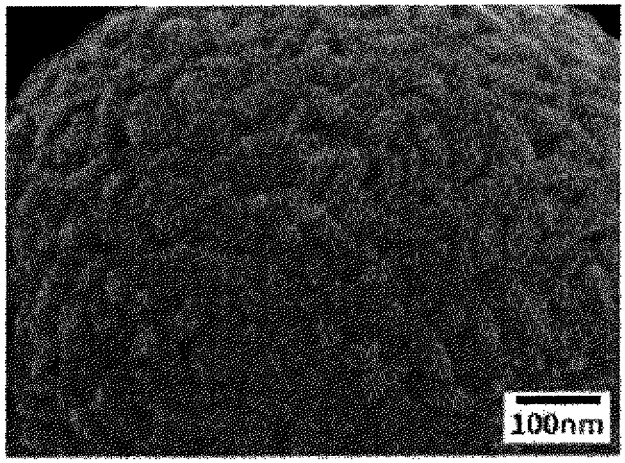
Figure 6:
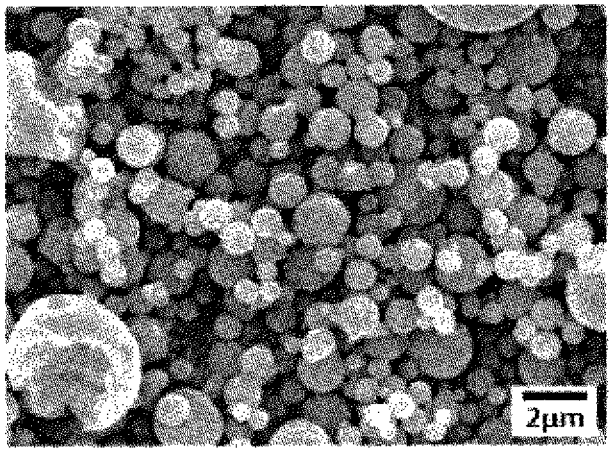
FIGS. 6 and 7 are scanning electron microscope (SEM) photos of barium ferrite magnetic powder with sodium chloride synthesized according to Example 2.
Figure 7:
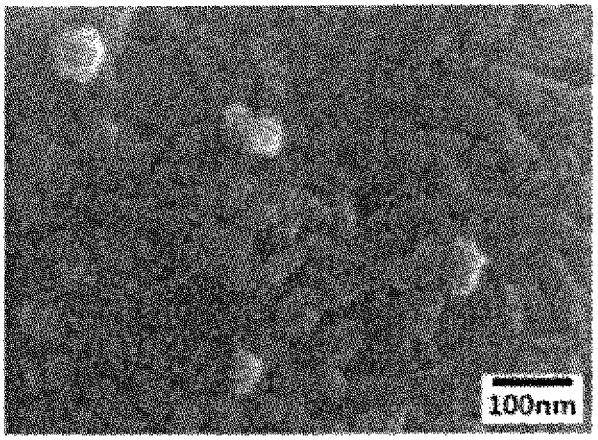
Figure 8:
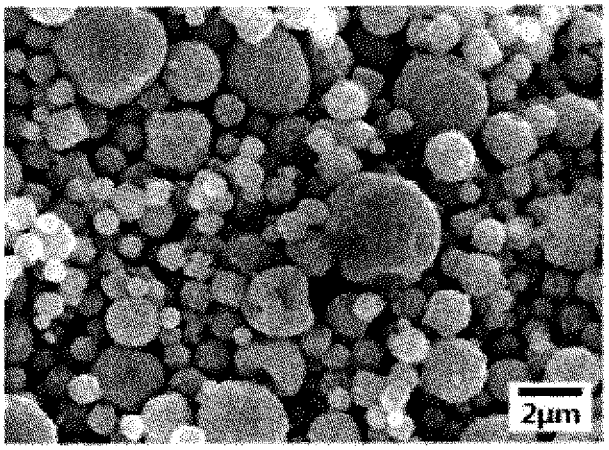
FIGS. 8 and 9 are scanning electron microscope (SEM) photos of barium ferrite magnetic powder with sodium chloride synthesized according to Example 3.
Figure 9:
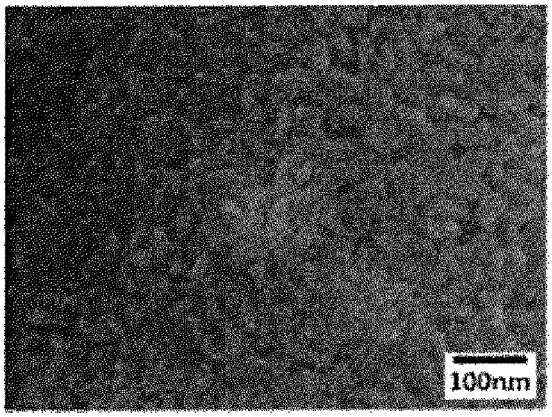

FIGS. 4 and 5 are scanning electron microscope (SEM) photos of barium ferrite magnetic powder with sodium chloride synthesized according to Example 1, and FIGS. 6 and 7 are scanning electron microscope (SEM) photos of barium ferrite magnetic powder with sodium chloride synthesized according to Example 2, and FIGS. 8 and 9 are scanning electron microscope (SEM) photos of barium ferrite magnetic powder with sodium chloride synthesized according to Example 3.

Referring to FIGS. 4 through 9, it is seen that barium ferrite with sodium chloride was well formed, and the formed barium ferrite particles with sodium chloride exhibited a primary particle size of less than 100 nm and a secondary particle size cohered to the primary particles was less than 5 μm. As illustrated in FIGS. 5, 7 and 9, there is shown a tendency that the size of primary particles decreases as increasing the content of sodium chloride in the enlarged photos.

Example 4

$Ba(NO_3)_2$ and $Fe(NO_3)_3.9H_2O$ were used for a source material of barium ferrite. A mixture in which $Ba(NO_3)_2$ and $Fe(NO_3)_3.9H_2O$ are mixed in a molar ratio of 1:12 was used for the source material of barium ferrite. Specifically, $Ba(NO_3)_2$ and $Fe(NO_3)_3.9H_2O$ were added to deionized water and stirred for about an hour to prepare a source material of barium ferrite comprised of $Ba(NO_3)_2$ with a molar concentration of 0.05M and $Fe(NO_3)_3.9H_2O$ with a molar concentration of 0.6M.

Potassium chloride (KCl) was added to the source material of barium ferrite to prepare a starting material. The potassium chloride was weighed to have a weight ratio of 19% with respect to potassium chloride ferrite magnetic powder (19 weight % with respect to 100 weight % of potassium chloride ferrite magnetic powder) and added.

The starting material was sprayed to form liquid droplets and allowed to pass through a reaction chamber heated at an inlet temperature of about 400° C., and an outlet temperature of about 850° C. along with a carrier gas ($O_2$), thereby synthesizing potassium chloride barium ferrite magnetic powder.

Hereinafter, a method of forming potassium chloride barium ferrite magnetic powder using a spray pyrolysis method will be described in more detail.

Power was supplied to a heating means surrounding the circumference of a reaction chamber in a spray pyrolysis apparatus to heat the reaction chamber so as to maintain an inlet temperature of about 400° C., and an outlet temperature of 850° C.

A carrier gas was supplied to a sprayer containing the starting material. Oxygen gas ($O_2$) was used for the carrier gas. The supply flow rate of the carrier gas was set to about 1.5 l/min.

The starting material contained in the sprayer was vibrated by an ultrasonic transducer to generate liquid droplets in the sprayer, and the liquid droplets were introduced into the reaction chamber by the carrier gas and subjected to the pyrolysis and oxidation reaction to synthesize potassium chloride barium ferrite magnetic powder. The potassium chloride barium ferrite magnetic powder formed through the pyrolysis and oxidation reaction was collected by the collector made of a paper filter.

Example 5

A starting material was prepared using a source material of barium ferrite and sodium chloride similarly to the Example 4, but potassium chloride was weighed to have a weight ratio of 31% with respect to potassium chloride ferrite magnetic powder (31 weight % with respect to 100 weight % of potassium chloride ferrite magnetic powder) and added.

The starting material was sprayed to form liquid droplets and allowed to pass through a reaction chamber heated at an inlet temperature of about 400° C., and an outlet temperature of about 850° C. along with a carrier gas ($O_2$) similarly to the Example 4, thereby synthesizing potassium chloride barium ferrite magnetic powder.

Example 6

A starting material was prepared using a source material of barium ferrite and potassium chloride similarly to the Example 4, but potassium chloride was weighed to have a weight ratio of 53% with respect to potassium chloride ferrite magnetic powder (53 weight % with respect to 100 weight % of potassium chloride ferrite magnetic powder) and added.

The starting material was sprayed to form liquid droplets and allowed to pass through a reaction chamber heated at an inlet temperature of about 400° C., and an outlet temperature of about 850° C. along with a carrier gas ($O_2$) similarly to the Example 4, thereby synthesizing potassium chloride barium ferrite magnetic powder.

Figure 10:
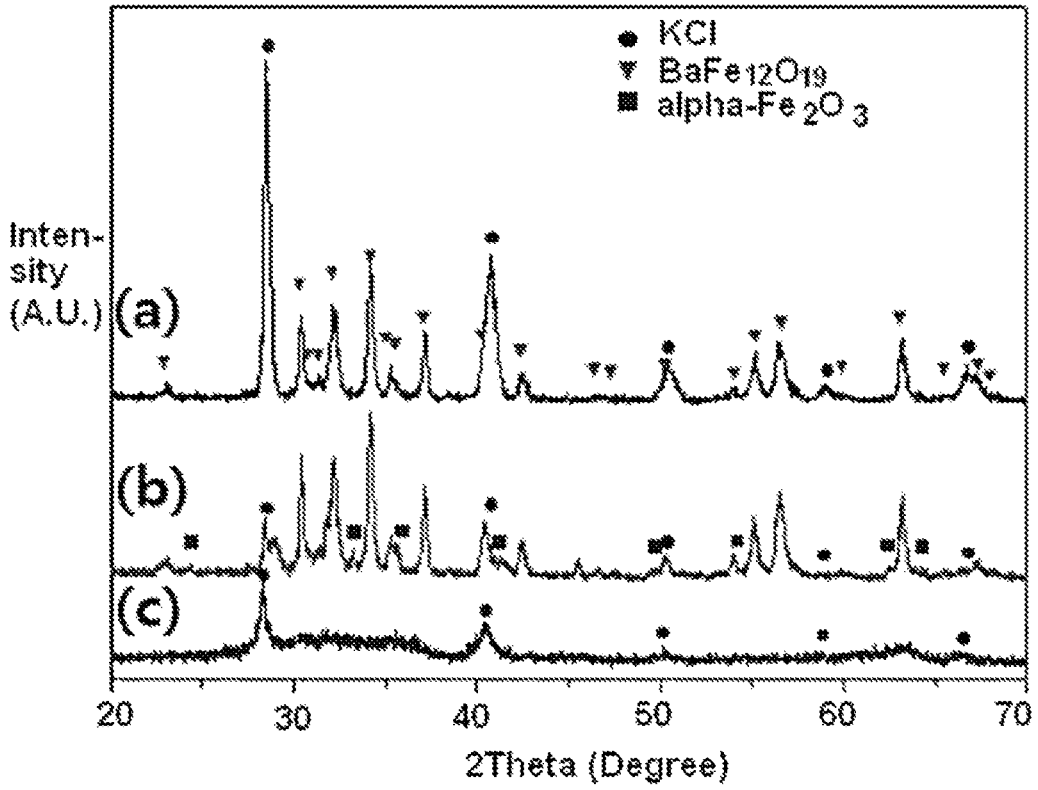
FIG. 10 is a graph illustrating an X-ray diffraction (XRD) pattern of barium ferrite magnetic powder with potassium chloride synthesized according to Examples 4 through 6.

FIG. 10 is a graph illustrating an X-ray diffraction (XRD) pattern of barium ferrite magnetic powder with potassium chloride synthesized according to Examples 4 through 6. FIG. 10A illustrates an X-ray diffraction (XRD) pattern of barium ferrite magnetic powder with potassium chloride synthesized according to Example 4, and FIG. 10B illustrates an X-ray diffraction (XRD) pattern of barium ferrite magnetic powder with potassium chloride synthesized according to Example 5, and FIG. 10C illustrates an X-ray diffraction (XRD) pattern of barium ferrite magnetic powder with potassium chloride synthesized according to Example 6.

Referring to FIG. 10, potassium chloride (KCl) and barium ferrite ($BaFe_{12}O_{19}$) crystalline phases were shown in all Examples 4 through 6, and hematite ($\alpha$-$Fe_2O_3$) crystalline phases were shown in case of Example 5. It is shown that the peak of sodium chloride is increased as increasing the added amount of salt. However, barium ferrite phases were not observed in Example 4 with a small added amount of salt.

Figure 11:
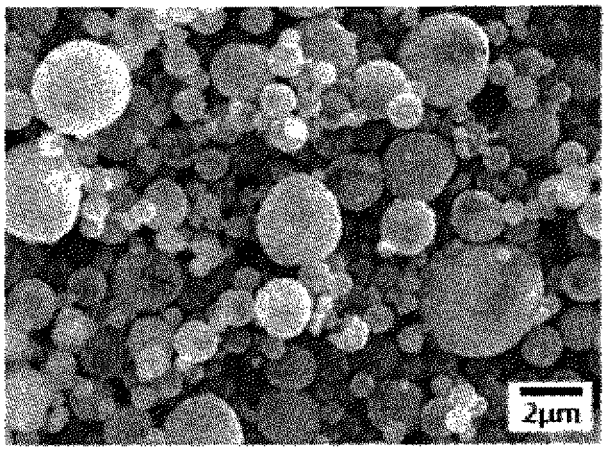
FIGS. 11 and 12 are scanning electron microscope (SEM) photos of barium ferrite magnetic powder with potassium chloride synthesized according to Example 4.
Figure 12:
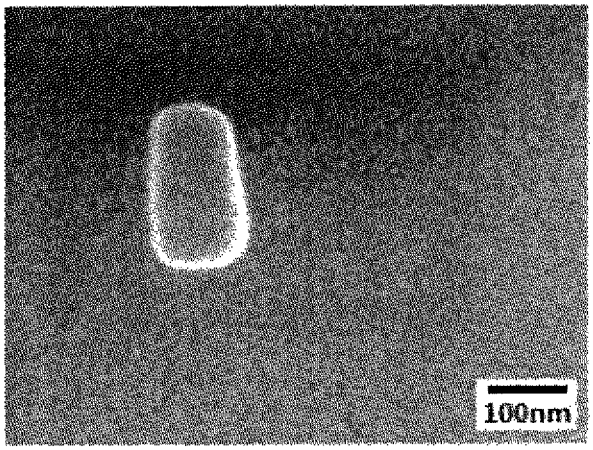
Figure 13:
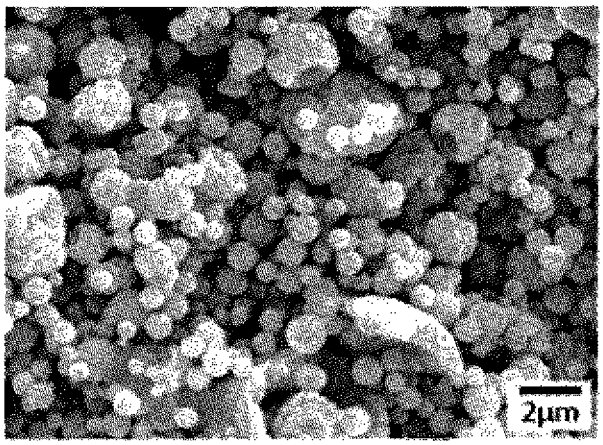
FIGS. 13 and 14 are scanning electron microscope (SEM) photos of barium ferrite magnetic powder with potassium chloride synthesized according to Example 5.
Figure 14:
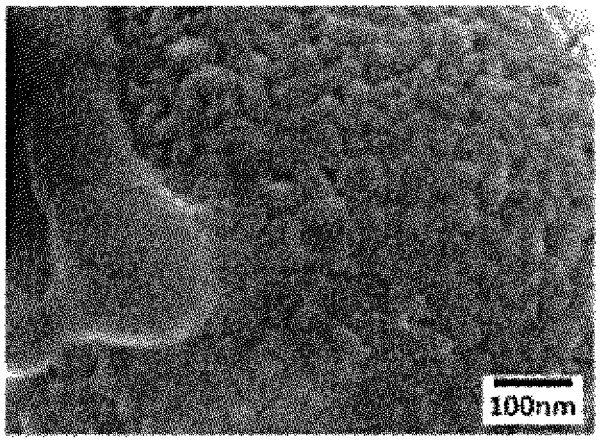
Figure 15:
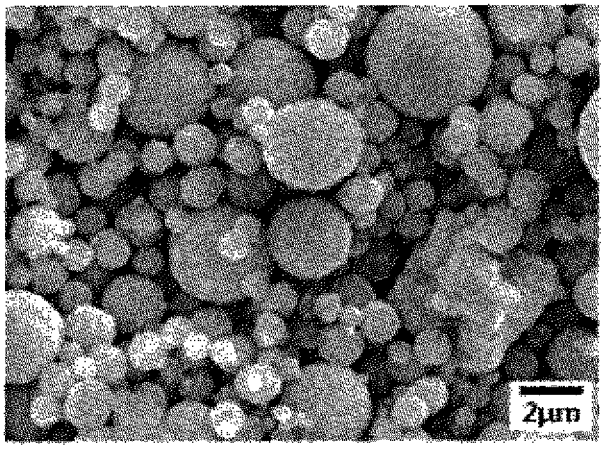
FIGS. 15 and 16 are scanning electron microscope (SEM) photos of barium ferrite magnetic powder with potassium chloride synthesized according to Example 6.
Figure 16:
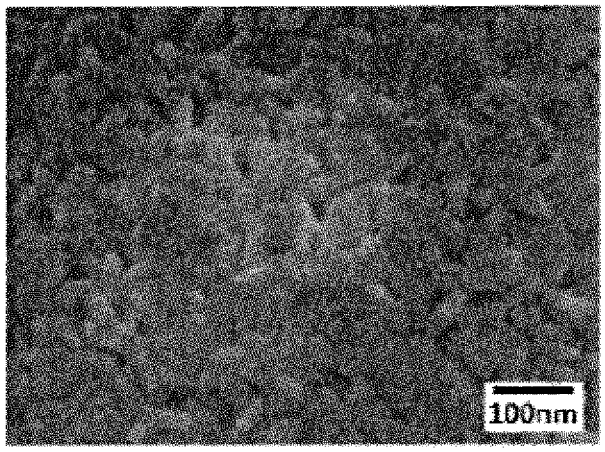

FIGS. 11 and 12 are scanning electron microscope (SEM) photos of barium ferrite magnetic powder with potassium chloride synthesized according to Example 4, and FIGS. 13 and 14 are scanning electron microscope (SEM) photos of barium ferrite magnetic powder with potassium chloride synthesized according to Example 5, and FIGS. 15 and 16 are scanning electron microscope (SEM) photos of barium ferrite magnetic powder with potassium chloride synthesized according to Example 6.

Referring to FIGS. 11 through 16, it is seen that barium ferrite with potassium chloride was well formed, and the formed barium ferrite particles with potassium chloride exhibited a primary particle size of less than 100 nm and a secondary particle size cohered to the primary particles was less than 5 μm. In a high magnification photo of FIG. 12, it is shown that particles were very small, and thus it is estimated that they were amorphous particles in a state prior to creating a barium ferrite phase when the X-ray diffraction results are taken into consideration in a comprehensive manner. When taking the results into consideration, it is seen that barium ferrite phases were not formed when potassium chloride was added at a concentration of 19% with respect to barium ferrite magnetic powder with potassium chloride at a synthetic temperature of 850° C.

Comparative Examples that can be compared with Examples will be disclosed to easily understand the characteristics of the above Examples 1 through 6. The following Comparative Examples 1 through 3 are disclosed herein to simply compare them with the characteristics of the Examples, and it is apparent that they are not the prior art of the present invention.

Comparative Example 1

Barium ferrite magnetic powder was synthesized without adding salt according to the following Comparative Examples.

$Ba(NO_3)_2$ and $Fe(NO_3)_3.9H_2O$ were used for a source material of barium ferrite. A mixture in which $Ba(NO_3)_2$ and $Fe(NO_3)_3.9H_2O$ are mixed in a molar ratio of 1:12 was used for the source material of barium ferrite. Specifically, $Ba(NO_3)_2$ and $Fe(NO_3)_3.9H_2O$ were added to deionized water and stirred for about an hour to prepare a source material of barium ferrite comprised of $Ba(NO_3)_2$ with a molar concentration of 0.05M and $Fe(NO_3)_3.9H_2O$ with a molar concentration of 0.6M.

The source material of barium ferrite was sprayed to form liquid droplets and allowed to pass through a reaction chamber heated at an inlet temperature of about 400° C., and an outlet temperature of about 850° C. along with a carrier gas ($O_2$), thereby synthesizing barium ferrite magnetic powder.

Hereinafter, a method of forming barium ferrite magnetic powder using a spray pyrolysis method will be described in more detail.

Power was supplied to a heating means surrounding the circumference of a reaction chamber in a spray pyrolysis apparatus to heat the reaction chamber so as to maintain an inlet temperature of about 400° C., and an outlet temperature of 850° C.

A carrier gas was supplied to a sprayer containing the source material of barium ferrite. Oxygen gas ($O_2$) was used for the carrier gas. The supply flow rate of the carrier gas was set to about 1.5 l/min.

The source material of barium ferrite contained in the sprayer was vibrated by an ultrasonic transducer to generate liquid droplets in the sprayer, and the liquid droplets were introduced into the reaction chamber by the carrier gas and subjected to the pyrolysis and oxidation reaction to synthesize barium ferrite magnetic powder. The barium ferrite magnetic powder formed through the pyrolysis and oxidation reaction was collected by the collector made of a paper filter.

Comparative Example 2

A source material of barium ferrite was used similarly to the Comparative Example 1.

The source material of barium ferrite was sprayed to form liquid droplets and allowed to pass through a reaction chamber heated at an inlet temperature of about 400° C., and an outlet temperature of about 900° C. along with a carrier gas ($O_2$) similarly to the Comparative Example 1, thereby synthesizing barium ferrite magnetic powder.

Comparative Example 3

A source material of barium ferrite was used similarly to the Comparative Example 1

The source material of barium ferrite was sprayed to form liquid droplets and allowed to pass through a reaction chamber heated at an inlet temperature of about 400° C., and an outlet temperature of about 950° C. along with a carrier gas ($O_2$) similarly to the Comparative Example 1, thereby synthesizing barium ferrite magnetic powder.

Figure 17:
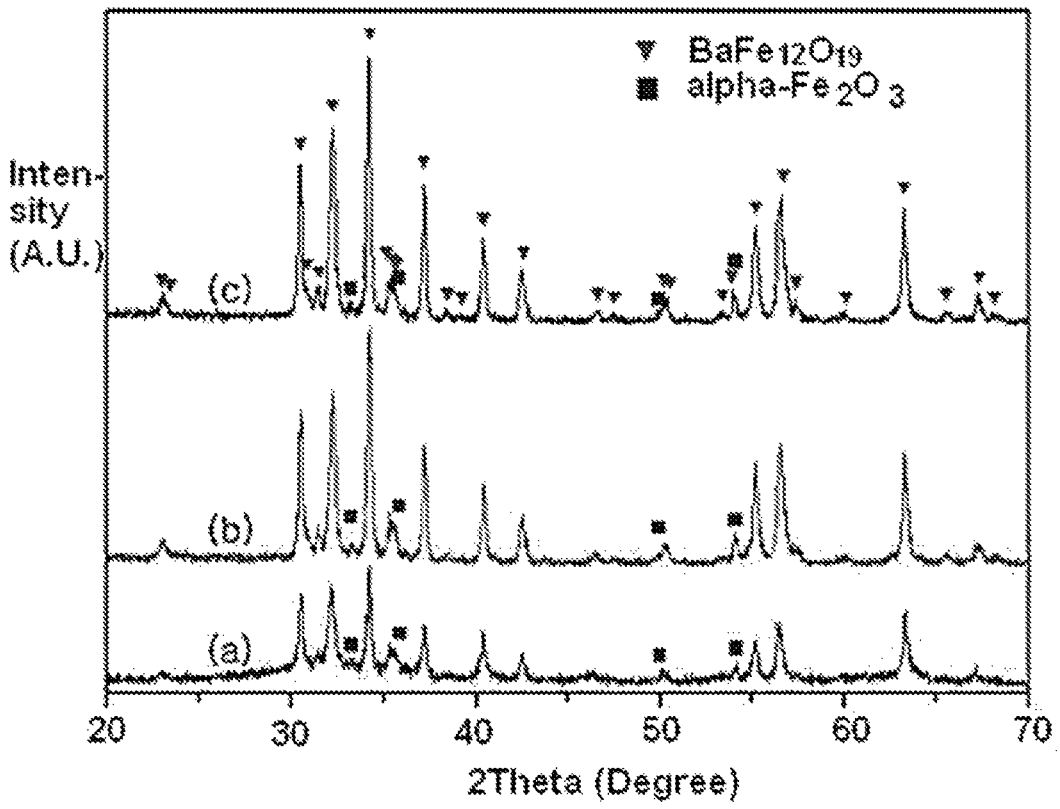
FIG. 17 is a graph illustrating an X-ray diffraction (XRD) pattern of barium ferrite magnetic powder synthesized according to Comparative Examples 1 through 3.

FIG. 17 is a graph illustrating an X-ray diffraction (XRD) pattern of barium ferrite magnetic powder synthesized according to Comparative Examples 1 through 3. FIG. 17A illustrates an X-ray diffraction (XRD) pattern of barium ferrite magnetic powder synthesized according to Comparative Example 1, and FIG. 17B illustrates an X-ray diffraction (XRD) pattern of barium ferrite magnetic powder synthesized according to Comparative Example 2, and FIG. 17C illustrates an X-ray diffraction (XRD) pattern of barium ferrite magnetic powder synthesized according to Comparative Example 3.

Referring to FIG. 17, barium ferrite ($BaFe_{12}O_{19}$) phases were shown in all Comparative Examples 1 through 3, and hematite ($\alpha$-$Fe_2O_3$) crystalline phases were shown in all Comparative Examples 1 through 3.

Figure 18:
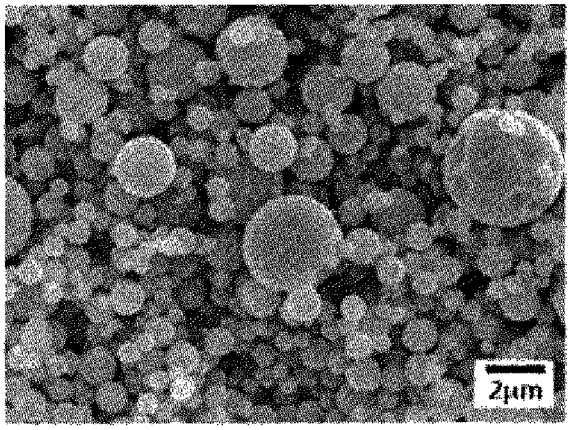
FIGS. 18 and 19 are scanning electron microscope (SEM) photos of barium ferrite magnetic powder synthesized according to Comparative Example 1.
Figure 19:
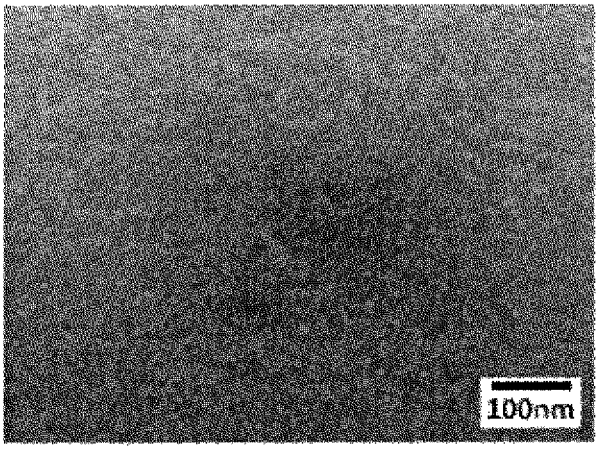
Figure 20:
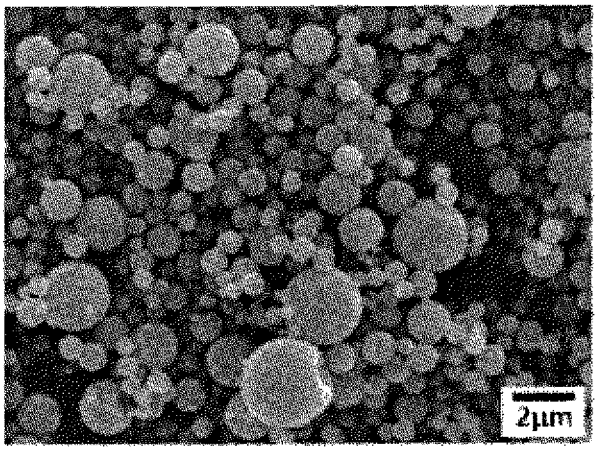
FIGS. 20 and 21 are scanning electron microscope (SEM) photos of barium ferrite magnetic powder synthesized according to Comparative Example 2.
Figure 21:
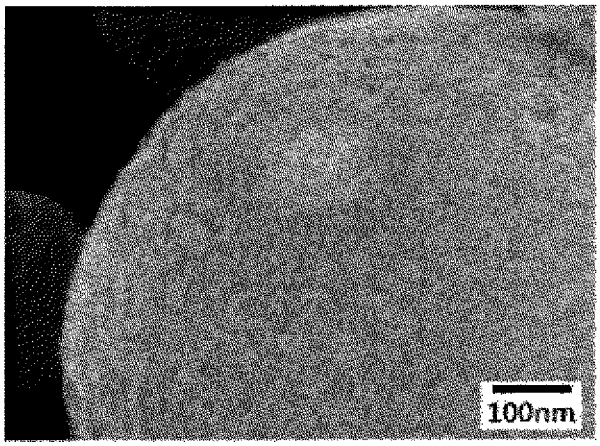
Figure 22:
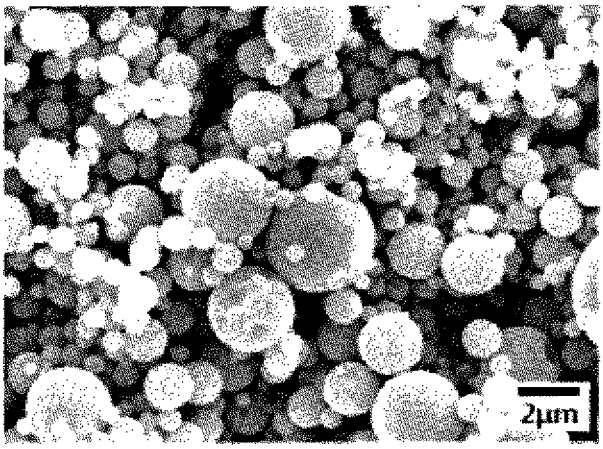
FIGS. 22 and 23 are scanning electron microscope (SEM) photos of barium ferrite magnetic powder synthesized according to Comparative Example 3.
Figure 23:
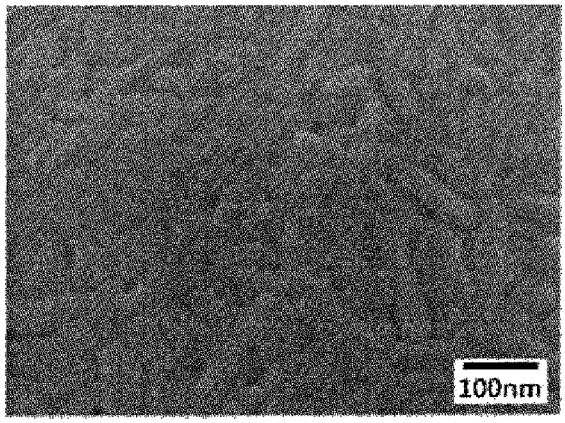

FIGS. 18 and 19 are scanning electron microscope (SEM) photos of barium ferrite magnetic powder synthesized according to Comparative Example 1, and FIGS. 20 and 21 are scanning electron microscope (SEM) photos of barium ferrite magnetic powder synthesized according to Comparative Example 2, and FIGS. 22 and 23 are scanning electron microscope (SEM) photos of barium ferrite magnetic powder synthesized according to Comparative Example 3.

Referring to FIGS. 18 through 23, it is seen that the size of particles was increased as increasing the temperature within the reaction chamber, and also seen that a barium ferrite phase was formed as a result of X-ray diffraction though it is difficult to check due to small sized particles at 850° C.

When salt was not added as disclosed in the Comparative Examples, hematite with an intermediate phase was found even at a high temperature of 950° C., but barium ferrite phases having a good crystallinity were obtained even at 850° C. when salt was added (in case of Examples 3 and 6). It illustrates that a ferrite magnet having a high crystallinity can be synthesized even with a short period of reaction time in the unit of second such as a spray pyrolysis method used in the Comparative Examples.

Furthermore, plate shaped and rod shaped particles exist for a single crystalline sample of barium ferrite, and samples to which salt is not added do not grow in a single crystalline shape but grow while being cohered to one another during the growth of particles, thereby causing the deterioration of magnetic characteristics. However, when salt is added, particles do not grow while being cohered to one another but remain in a single crystalline shape, thus exhibiting that magnetic characteristics can be enhanced when crystalline samples are aligned to one another.

Example 7

Considering a molding condition subsequent to manufacturing barium ferrite with salt, an experiment was carried out at temperatures lower than those of Examples 1 through 3, and a smaller amount of salt addition condition was also used.

$Ba(NO_3)_2$ and $Fe(NO_3)_3.9H_2O$ were used for a source material of barium ferrite. A mixture in which $Ba(NO_3)_2$ and $Fe(NO_3)_3.9H_2O$ are mixed in a molar ratio of 1:12 was used for the source material of barium ferrite. Specifically, $Ba(NO_3)_2$ and $Fe(NO_3)_3.9H_2O$ were added to deionized water and stirred for about an hour to prepare a source material of barium ferrite comprised of $Ba(NO_3)_2$ with a molar concentration of 0.05M and $Fe(NO_3)_3.9H_2O$ with a molar concentration of 0.6M.

Sodium chloride (NaCl) was added to the source material of barium ferrite to prepare a starting material. The sodium chloride was weighed to have a weight ratio of 5% with respect to ferrite magnetic powder with salt (5 weight % with respect to 100 weight % of ferrite magnetic powder with salt) and added.

The starting material was sprayed to form liquid droplets and allowed to pass through a reaction chamber heated at an inlet temperature of about 400° C., and an outlet temperature of about 800° C. along with a carrier gas ($O_2$), thereby synthesizing barium ferrite magnetic powder with salt.

Hereinafter, a method of forming barium ferrite magnetic powder with salt using a spray pyrolysis method will be described in more detail.

Power was supplied to a heating means surrounding the circumference of a reaction chamber in a spray pyrolysis apparatus to heat the reaction chamber so as to maintain an inlet temperature of about 400° C., and an outlet temperature of 850° C.

A carrier gas was supplied to a sprayer containing the starting material. Oxygen gas ($O_2$) was used for the carrier gas. The supply flow rate of the carrier gas was set to about 1.5 l/min.

The starting material contained in the sprayer was vibrated by an ultrasonic transducer to generate liquid droplets in the sprayer, and the liquid droplets were introduced into the reaction chamber by the carrier gas and subjected to the pyrolysis and oxidation reaction to synthesize barium ferrite magnetic powder with sodium chloride. The barium ferrite magnetic powder with sodium chloride formed through the pyrolysis and oxidation reaction was collected by the collector made of a paper filter.

Example 8

A starting material was prepared using a source material of barium ferrite and sodium chloride similarly to the Example 7, but sodium chloride was weighed to have a weight ratio of 19% with respect to ferrite magnetic powder with salt (19 weight % with respect to 100 weight % of ferrite magnetic powder with salt) and added.

The starting material was sprayed to form liquid droplets and allowed to pass through a reaction chamber heated at an inlet temperature of about 400° C., and an outlet temperature of about 800° C. along with a carrier gas ($O_2$) similarly to the Example 7, thereby synthesizing barium ferrite magnetic powder with salt.

Example 9

A starting material was prepared using a source material of barium ferrite and sodium chloride similarly to the Example 7, but sodium chloride was weighed to have a weight ratio of 31% with respect to ferrite magnetic powder with salt (31 weight % with respect to 100 weight % of ferrite magnetic powder with salt) and added.

The starting material was sprayed to form liquid droplets and allowed to pass through a reaction chamber heated at an inlet temperature of about 400° C., and an outlet temperature of about 800° C. along with a carrier gas ($O_2$) similarly to the Example 7, thereby synthesizing barium ferrite magnetic powder with salt.

Figure 24:
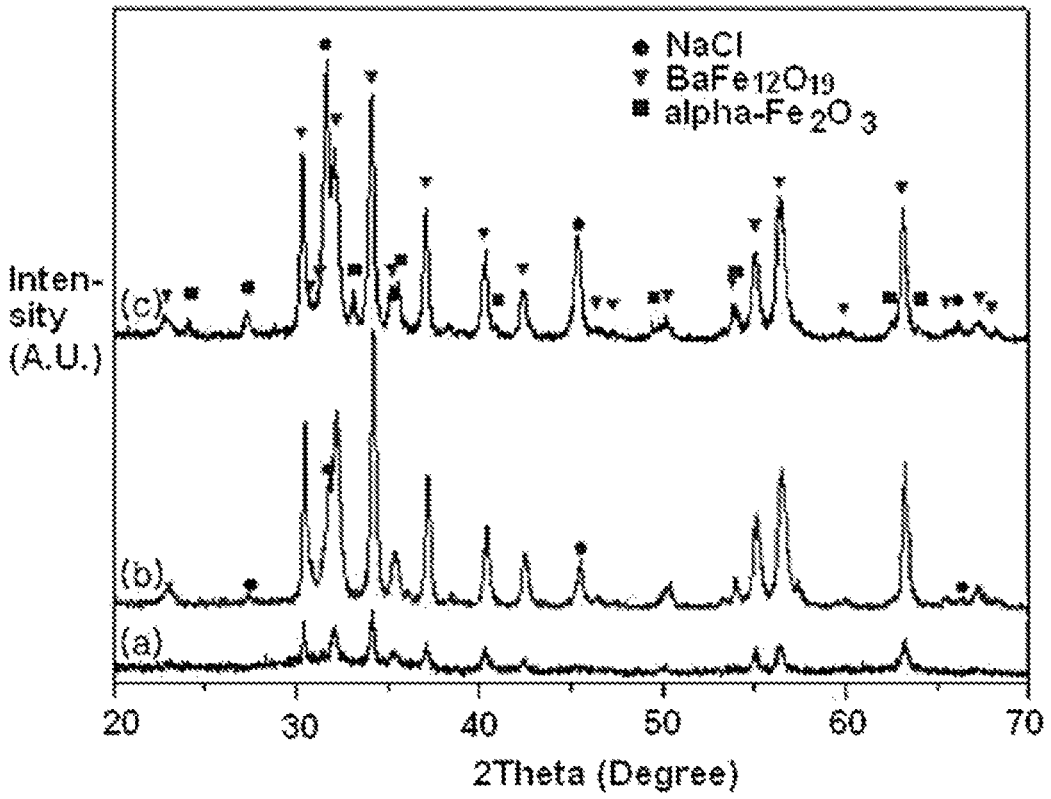
FIG. 24 is a graph illustrating an X-ray diffraction (XRD) pattern of barium ferrite magnetic powder with sodium chloride synthesized according to Examples 7 through 9.

FIG. 24 is a graph illustrating an X-ray diffraction (XRD) pattern of barium ferrite magnetic powder with sodium chloride synthesized according to Examples 7 through 9. FIG. 24A illustrates an X-ray diffraction (XRD) pattern of barium ferrite magnetic powder with sodium chloride synthesized according to Example 7, and FIG. 24B illustrates an X-ray diffraction (XRD) pattern of barium ferrite magnetic powder with sodium chloride synthesized according to Example 8, and FIG. 24C illustrates an X-ray diffraction (XRD) pattern of barium ferrite magnetic powder with sodium chloride synthesized according to Example 9.

Referring to FIG. 24, sodium chloride (NaCl) and barium ferrite ($BaFe_{12}O_{19}$) crystalline phases were shown in all Examples 7 through 9, and hematite ($\alpha$-$Fe_2O_3$) crystalline phases were shown in Example 9, but the hematite ($\alpha$-$Fe_2O_3$) crystalline phases were not shown in Examples 7 and 8.

Figure 25:
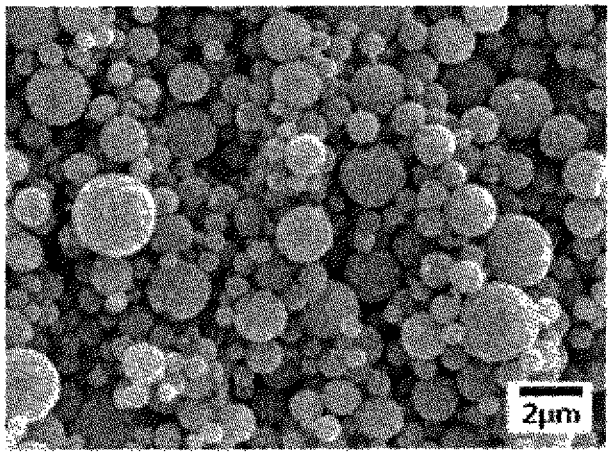
FIGS. 25 and 26 are scanning electron microscope (SEM) photos of barium ferrite magnetic powder with sodium chloride synthesized according to Example 7.
Figure 26:
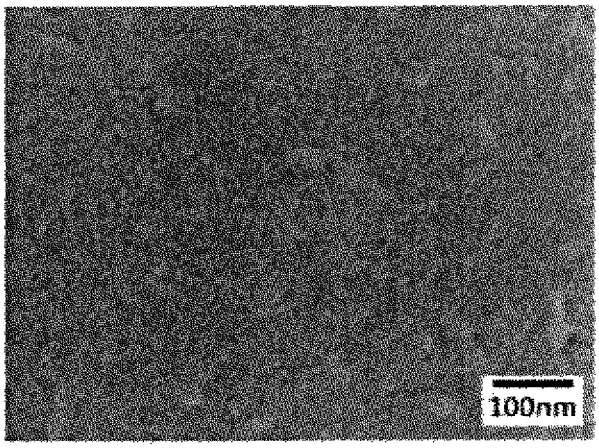
Figure 27:
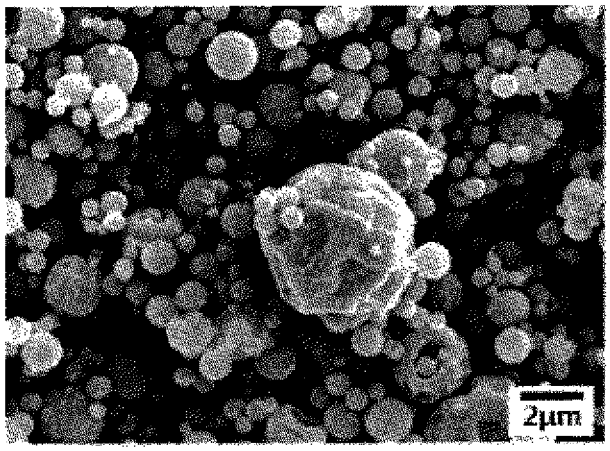
FIGS. 27 and 28 are scanning electron microscope (SEM) photos of barium ferrite magnetic powder with sodium chloride synthesized according to Example 8.
Figure 28:
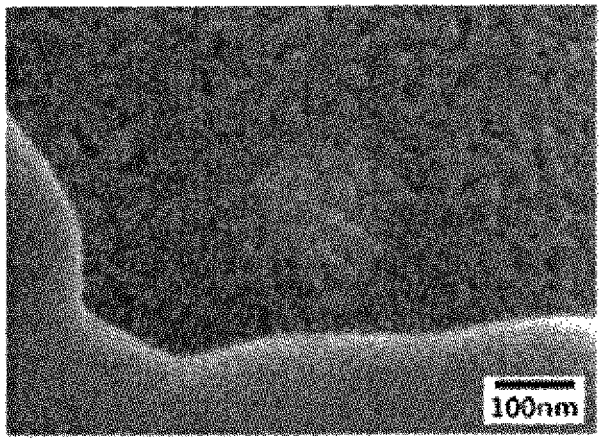
Figure 29:
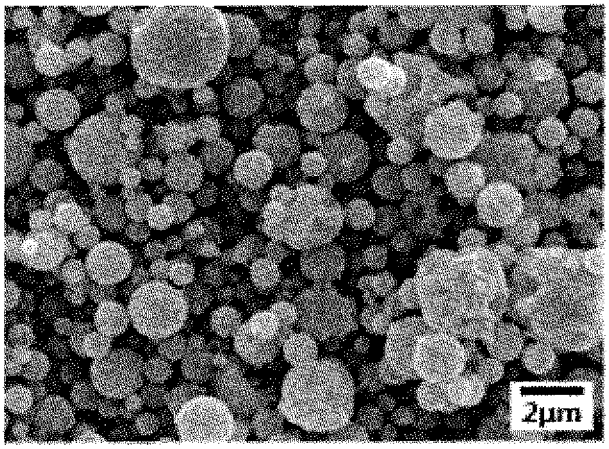
FIGS. 29 and 30 are scanning electron microscope (SEM) photos of barium ferrite magnetic powder with sodium chloride synthesized according to Example 9.
Figure 30:
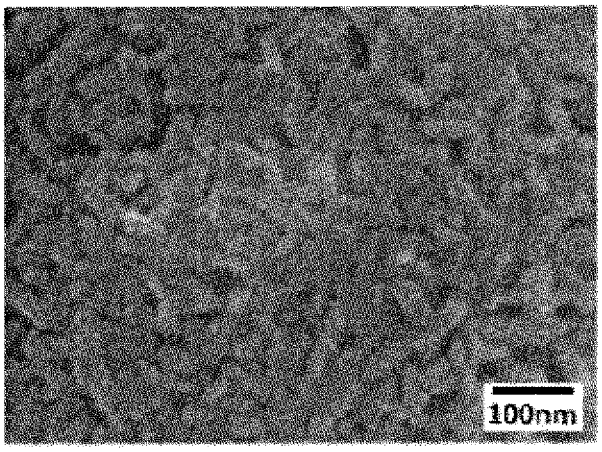

FIGS. 25 and 26 are scanning electron microscope (SEM) photos of barium ferrite magnetic powder with sodium chloride synthesized according to Example 7, and FIGS. 27 and 28 are scanning electron microscope (SEM) photos of barium ferrite magnetic powder with sodium chloride synthesized according to Example 8, and FIGS. 29 and 30 are scanning electron microscope (SEM) photos of barium ferrite magnetic powder with sodium chloride synthesized according to Example 9.

Referring to FIGS. 25 through 30, it is seen that barium ferrite with sodium chloride was well formed, and the formed barium ferrite particles with sodium chloride exhibited a primary particle size of less than 100 nm and a secondary particle size cohered to the primary particles was less than 5 μm. In case where salt was added in a weight ratio of 19% with respect to barium ferrite magnetic powder with salt (in case of Example 8) and in case where salt was added in a weight ratio of 31% (in case of Example 9), an almost similar size of particles was shown. However, in case where salt is added in a weight ratio of 5% (in case of Example 7), the growth of particles did not occur and the particle size was small.

Example 10

Considering a molding condition subsequent to manufacturing barium ferrite with salt, an experiment was carried out at temperatures lower than those of Examples 4 through 6, and a smaller amount of salt addition condition was also used.

$Ba(NO_3)_2$ and $Fe(NO_3)_3.9H_2O$ were used for a source material of barium ferrite. A mixture in which $Ba(NO_3)_2$ and $Fe(NO_3)_3.9H_2O$ are mixed in a molar ratio of 1:12 was used for the source material of barium ferrite. Specifically, $Ba(NO_3)_2$ and $Fe(NO_3)_3.9H_2O$ were added to deionized water and stirred for about an hour to prepare a source material of barium ferrite comprised of $Ba(NO_3)_2$ with a molar concentration of 0.05M and $Fe(NO_3)_3.9H_2O$ with a molar concentration of 0.6M.

Potassium chloride (KCl) was added to the source material of barium ferrite to prepare a starting material. The potassium chloride was weighed to have a weight ratio of 5% with respect to ferrite magnetic powder with salt (5 weight % with respect to 100 weight % of ferrite magnetic powder with salt) and added.

The starting material was sprayed to form liquid droplets and allowed to pass through a reaction chamber heated at an inlet temperature of about 400° C., and an outlet temperature of about 800° C. along with a carrier gas ($O_2$), thereby synthesizing barium ferrite magnetic powder with salt.

Hereinafter, a method of forming barium ferrite magnetic powder with salt using a spray pyrolysis method will be described in more detail.

Power was supplied to a heating means surrounding the circumference of a reaction chamber in a spray pyrolysis apparatus to heat the reaction chamber so as to maintain an inlet temperature of about 400° C., and an outlet temperature of 800° C.

A carrier gas was supplied to a sprayer containing the starting material. Oxygen gas ($O_2$) was used for the carrier gas. The supply flow rate of the carrier gas was set to about 1.5 l/min.

The starting material contained in the sprayer was vibrated by an ultrasonic transducer to generate liquid droplets in the sprayer, and the liquid droplets were introduced into the reaction chamber by the carrier gas and subjected to the pyrolysis and oxidation reaction to synthesize barium ferrite magnetic powder with potassium chloride. The barium ferrite magnetic powder with potassium chloride formed through the pyrolysis and oxidation reaction was collected by the collector made of a paper filter.

Example 11

A starting material was prepared using a source material of barium ferrite and potassium chloride similarly to the Example 10, but potassium chloride was weighed to have a weight ratio of 19% with respect to ferrite magnetic powder with salt (19 weight % with respect to 100 weight % of ferrite magnetic powder with salt) and added.

The starting material was sprayed to form liquid droplets and allowed to pass through a reaction chamber heated at an inlet temperature of about 400° C., and an outlet temperature of about 800° C. along with a carrier gas ($O_2$) similarly to the Example 10, thereby synthesizing barium ferrite magnetic powder with salt.

Example 12

A starting material was prepared using a source material of barium ferrite and potassium chloride similarly to the Example 10, but potassium chloride was weighed to have a weight ratio of 31% with respect to ferrite magnetic powder with salt (31 weight % with respect to 100 weight % of ferrite magnetic powder with salt) and added.

The starting material was sprayed to form liquid droplets and allowed to pass through a reaction chamber heated at an inlet temperature of about 400° C., and an outlet temperature of about 8050° C. along with a carrier gas ($O_2$) similarly to the Example 10, thereby synthesizing barium ferrite magnetic powder with salt.

Figure 31:
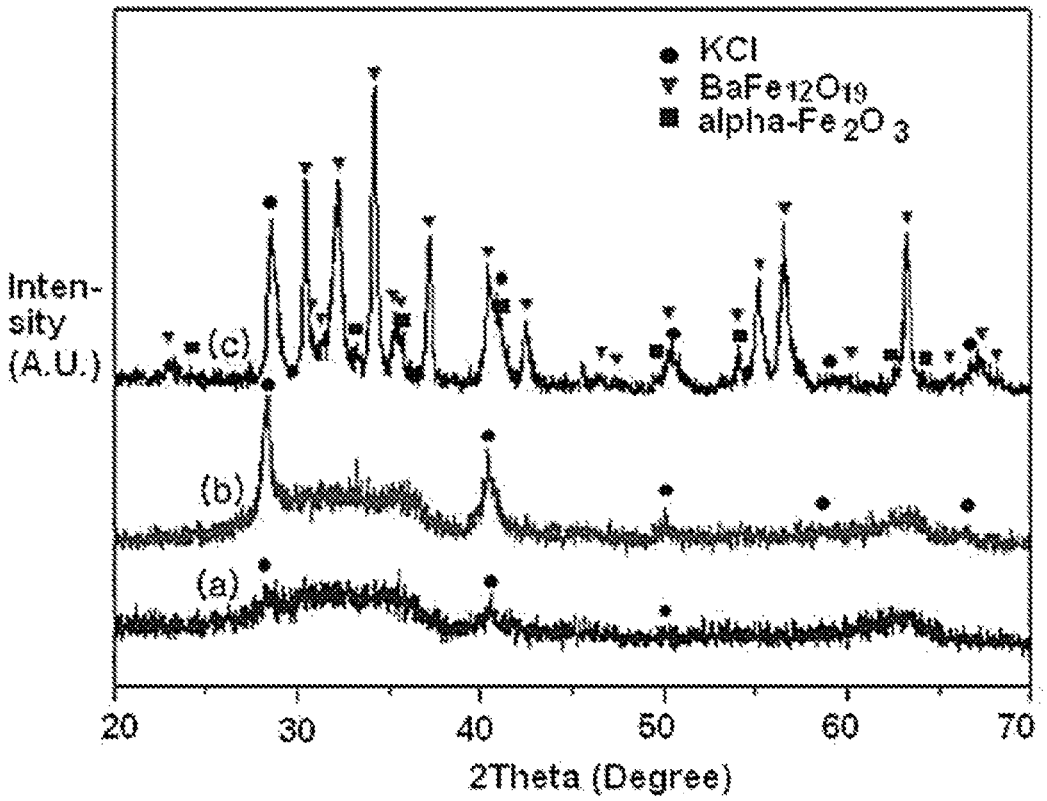
FIG. 31 is a graph illustrating an X-ray diffraction (XRD) pattern of barium ferrite magnetic powder with potassium chloride synthesized according to Examples 10 through 12.

FIG. 31 is a graph illustrating an X-ray diffraction (XRD) pattern of barium ferrite magnetic powder with potassium chloride synthesized according to Examples 10 through 12. FIG. 31A illustrates an X-ray diffraction (XRD) pattern of barium ferrite magnetic powder with potassium chloride synthesized according to Example 10, and FIG. 31B illustrates an X-ray diffraction (XRD) pattern of barium ferrite magnetic powder with potassium chloride synthesized according to Example 11, and FIG. 31C illustrates an X-ray diffraction (XRD) pattern of barium ferrite magnetic powder with potassium chloride synthesized according to Example 12.

Referring to FIG. 31, barium ferrite crystalline phases were shown in Example 12, but barium ferrite crystalline phases were not observed in Examples 10 and 11 excluding a case where salt is added in a weight ratio of 31% with respect to barium ferrite magnetic powder with salt. Potassium chloride crystalline phases were observed in all Examples 10 through 12.

Figure 32:
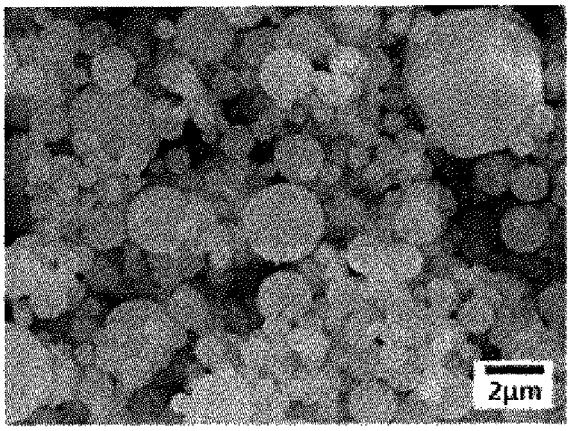
FIGS. 32 and 33 are scanning electron microscope (SEM) photos of barium ferrite magnetic powder with potassium chloride synthesized according to Example 10.
Figure 33:
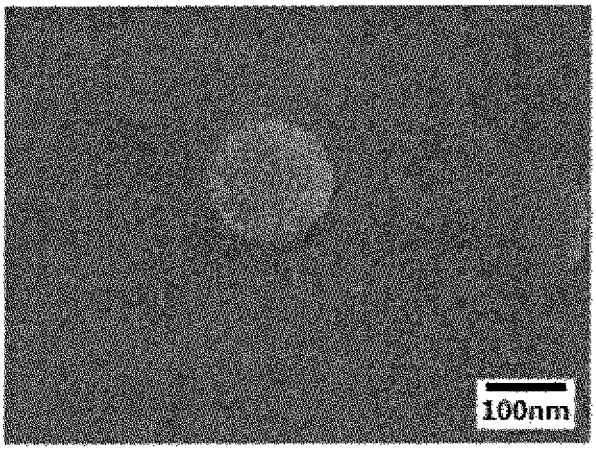
Figure 34:
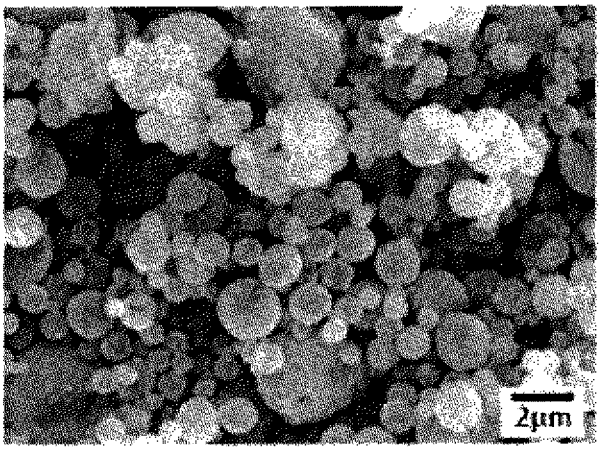
FIGS. 34 and 35 are scanning electron microscope (SEM) photos of barium ferrite magnetic powder with potassium chloride synthesized according to Example 11.
Figure 35:
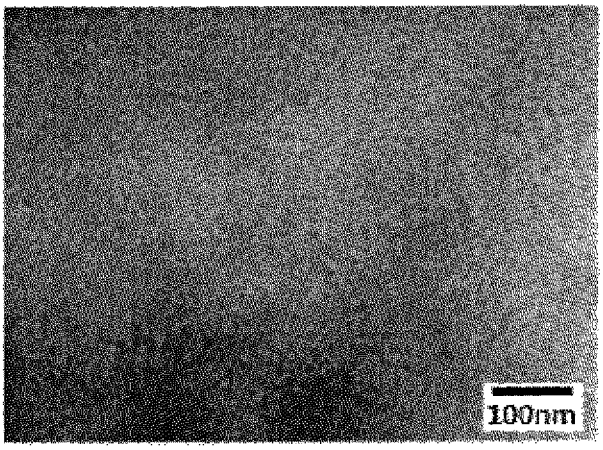
Figure 36:
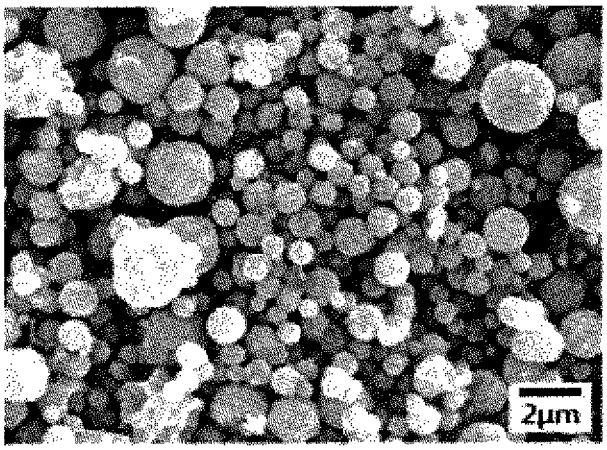
FIGS. 36 and 37 are scanning electron microscope (SEM) photos of barium ferrite magnetic powder with potassium chloride synthesized according to Example 12.
Figure 37:
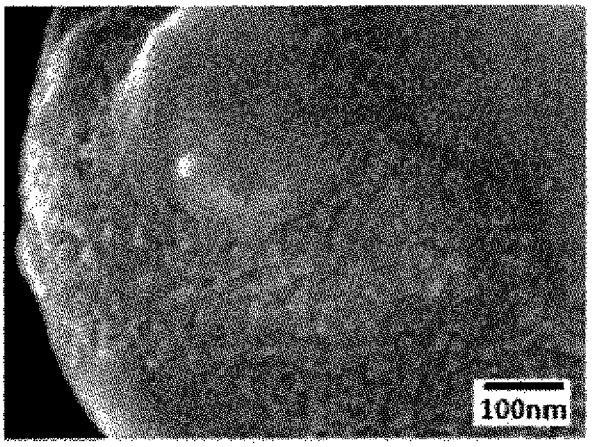

FIGS. 32 and 33 are scanning electron microscope (SEM) photos of barium ferrite magnetic powder with potassium chloride synthesized according to Example 10, and FIGS. 34 and 35 are scanning electron microscope (SEM) photos of barium ferrite magnetic powder with potassium chloride synthesized according to Example 11, and FIGS. 36 and 37 are scanning electron microscope (SEM) photos of barium ferrite magnetic powder with potassium chloride synthesized according to Example 12.

Referring to FIGS. 32 through 37, the form of barium ferrite particles was not clearly observed excluding a case where salt is added in a weight ratio of 31% with respect to barium ferrite magnetic powder with salt (in case of Example 12). In case of Examples 10 and 11, considering that barium ferrite phases were not exhibited in the X-ray diffraction in a collective manner, it is seen that barium ferrite crystalline phases were not formed to form an amorphous state.

Example 13

Considering a molding condition subsequent to manufacturing barium ferrite with salt, an experiment was carried out at temperatures lower than those of Examples 7 through 9, and a smaller amount of salt addition condition was also used.

$Ba(NO_3)_2$ and $Fe(NO_3)_3.9H_2O$ were used for a source material of barium ferrite. A mixture in which $Ba(NO_3)_2$ and $Fe(NO_3)_3.9H_2O$ are mixed in a molar ratio of 1:12 was used for the source material of barium ferrite. Specifically, $Ba(NO_3)_2$ and $Fe(NO_3)_3.9H_2O$ were added to deionized water and stirred for about an hour to prepare a source material of barium ferrite comprised of $Ba(NO_3)_2$ with a molar concentration of 0.05M and $Fe(NO_3)_3.9H_2O$ with a molar concentration of 0.6M.

Sodium chloride (NaCl) was added to the source material of barium ferrite to prepare a starting material. The sodium chloride was weighed to have a weight ratio of 5% with respect to ferrite magnetic powder with salt (5 weight % with respect to 100 weight % of ferrite magnetic powder with salt) and added.

Similarly to the Example 1, the starting material was sprayed to form liquid droplets and allowed to pass through a reaction chamber heated at an inlet temperature of about 250° C., and an outlet temperature of about 850° C. along with a carrier gas ($O_2$), thereby synthesizing barium ferrite magnetic powder with salt.

Hereinafter, a method of forming barium ferrite magnetic powder with salt using a spray pyrolysis method will be described in more detail.

Power was supplied to a heating means surrounding the circumference of a reaction chamber in a spray pyrolysis apparatus to heat the reaction chamber so as to maintain an inlet temperature of about 250° C., and an outlet temperature of 850° C.

A carrier gas was supplied to a sprayer containing the starting material. Oxygen gas ($O_2$) was used for the carrier gas. The supply flow rate of the carrier gas was set to about 1.5 l/min.

The starting material contained in the sprayer was vibrated by an ultrasonic transducer to generate liquid droplets in the sprayer, and the liquid droplets were introduced into the reaction chamber by the carrier gas and subjected to the pyrolysis and oxidation reaction to synthesize barium ferrite magnetic powder with sodium chloride. The barium ferrite magnetic powder with sodium chloride formed through the pyrolysis and oxidation reaction was collected by the collector made of a paper filter.

Example 14

A starting material was prepared using a source material of barium ferrite and sodium chloride similarly to the Example 13, but sodium chloride was weighed to have a weight ratio of 3% with respect to sodium chloride ferrite magnetic powder (3 weight % with respect to 100 weight % of sodium chloride ferrite magnetic powder) and added.

The starting material was sprayed to form liquid droplets and allowed to pass through a reaction chamber heated at an inlet temperature of about 250° C., and an outlet temperature of about 850° C. along with a carrier gas ($O_2$) similarly to the Example 13, thereby synthesizing barium sodium chloride ferrite magnetic powder.

Figure 38:
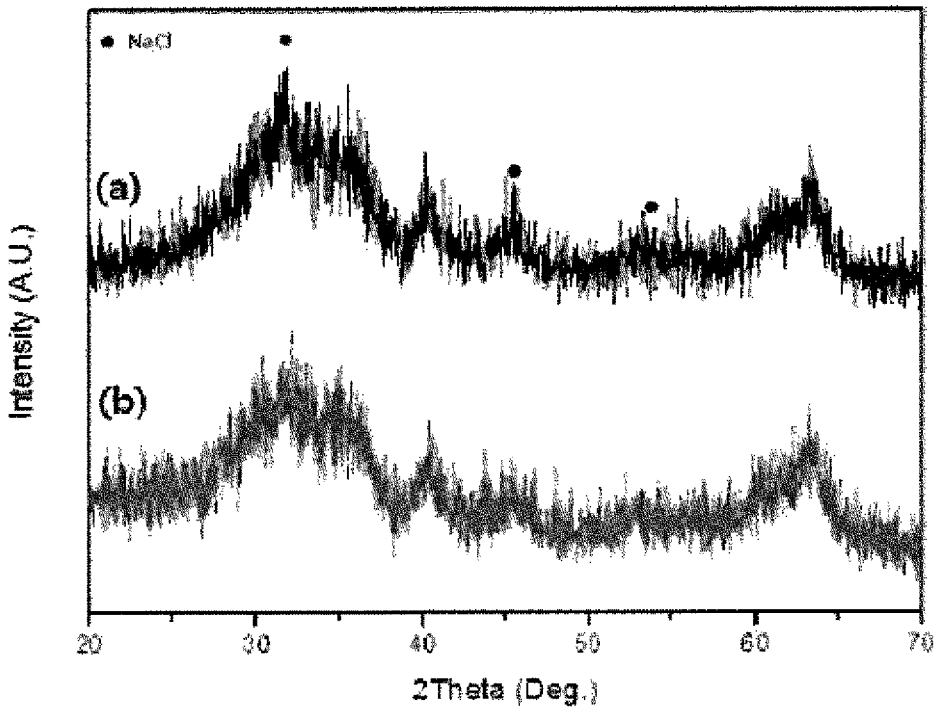
FIG. 38 is a graph illustrating an X-ray diffraction (XRD) pattern of barium ferrite magnetic powder with sodium chloride synthesized according to Examples 13 and 14.

FIG. 38 is a graph illustrating an X-ray diffraction (XRD) pattern of barium ferrite magnetic powder with sodium chloride synthesized according to Examples 13 and 14. FIG. 38A illustrates an X-ray diffraction (XRD) pattern of barium ferrite magnetic powder with sodium chloride synthesized according to Example 13, and FIG. 38B illustrates an X-ray diffraction (XRD) pattern of barium ferrite magnetic powder with sodium chloride synthesized according to Example 14.

Referring to FIG. 38, barium ferrite crystalline phases were not shown and sodium chloride phases were weakly observed in both Examples 13 and 14.

Figure 39:
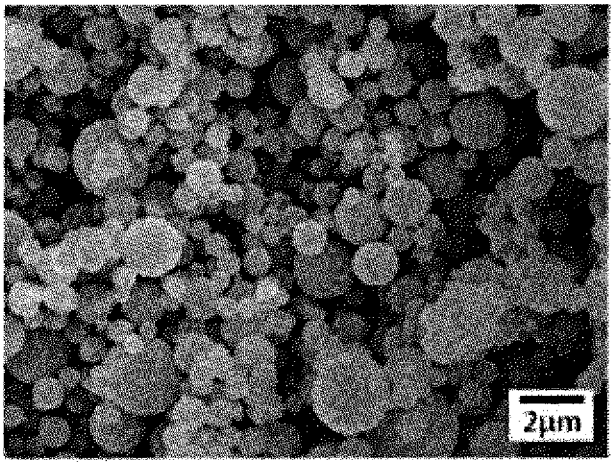
FIGS. 39 and 40 are scanning electron microscope (SEM) photos of barium ferrite magnetic powder with sodium chloride synthesized according to Example 13.
Figure 40:
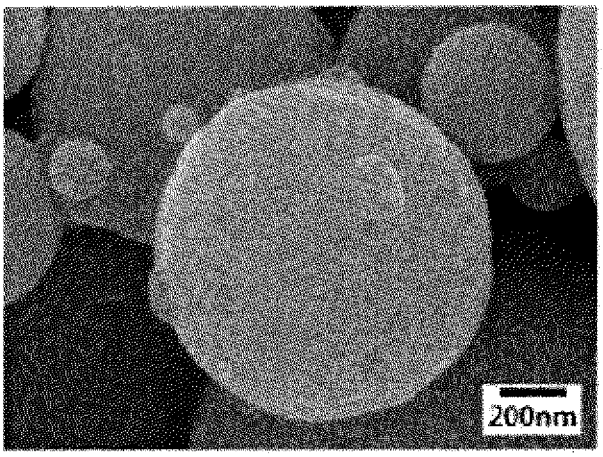
Figure 41:
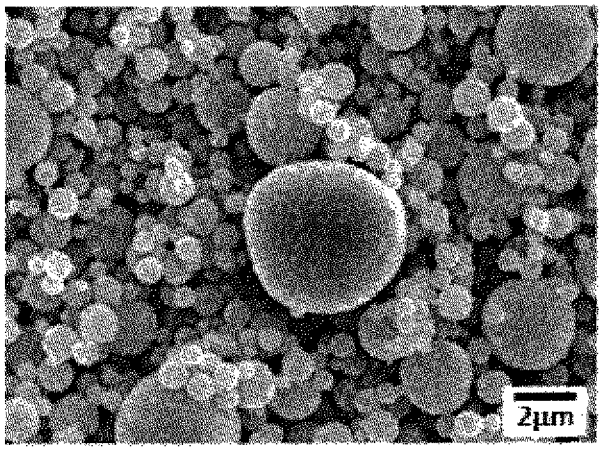
FIGS. 41 and 42 are scanning electron microscope (SEM) photos of barium ferrite magnetic powder with sodium chloride synthesized according to Example 14.
Figure 42:
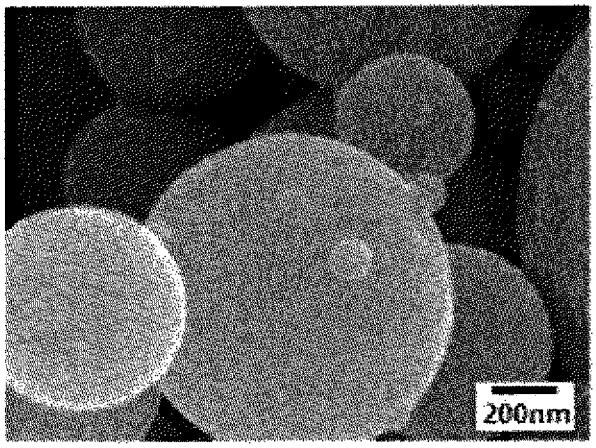

FIGS. 39 and 40 are scanning electron microscope (SEM) photos of barium ferrite magnetic powder with sodium chloride synthesized according to Example 13, and FIGS. 41 and 42 are scanning electron microscope (SEM) photos of barium ferrite magnetic powder with sodium chloride synthesized according to Example 14.

Referring to FIGS. 39 through 42, the form of barium ferrite particles was not clearly observed in both Examples 13 and 14. Considering that barium ferrite phases were not exhibited in the X-ray diffraction in a collective manner, it is seen that barium ferrite crystalline phases were not formed to form an amorphous state.

Example 15

Barium ferrite magnetic powder with salt synthesized according to Example 7 (in case where sodium chloride was added in a weight ratio of 5% with respect to barium ferrite magnetic powder with salt and synthesized at a temperature of 800° C.) was molded and sintered (with spark plasma sintering) to evaluate the magnetic characteristics using the formed sintered body (barium ferrite magnet with salt).

The molding and sintering conditions were as follows. Barium ferrite magnetic powder with salt synthesized according to Example 7 was filled into a molding frame with a carbon material and heated at a heating rate of 100° C. per minute to a target temperature of 700° C. under argon (Ar) atmosphere. The molding frame heated at 700° C. was maintained at a pressure of 100 MPa for two minutes and then cooled to obtain a sintered body (barium ferrite magnet with salt). The manufactured sintered body has a disc type, and was manufactured such that the height of the disc is greater than one half of the diameter thereof.

Figure 43:
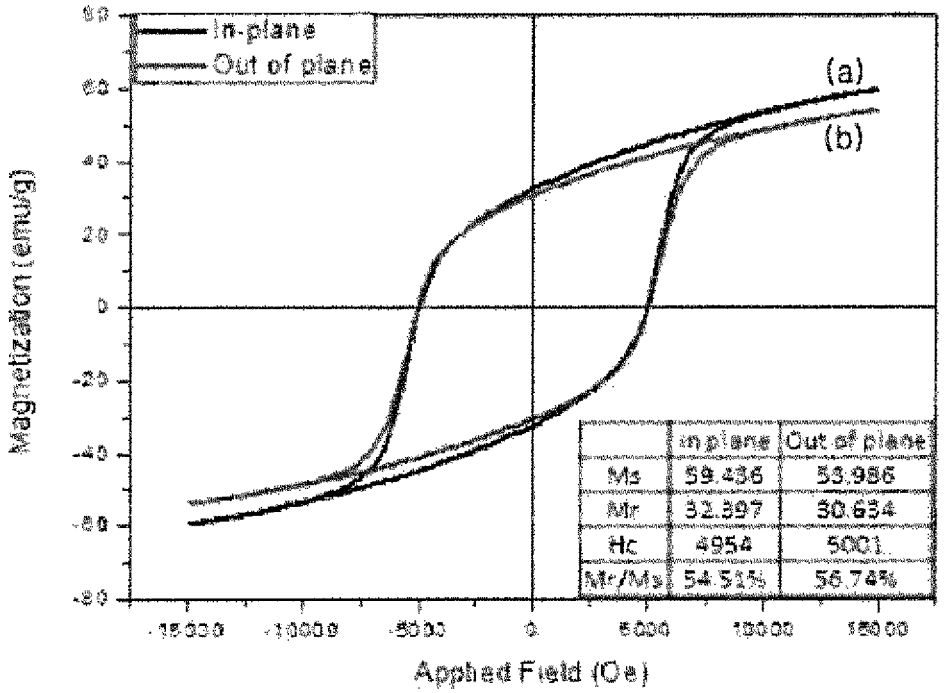
FIG. 43 is a graph in which magnetic characteristics are evaluated using a vibrating sample magnetometer (VSM) for a barium ferrite magnet with salt produced according to Example 15.

FIG. 43 is a graph in which magnetic characteristics are evaluated using a vibrating sample magnetometer (VSM) for a barium ferrite magnet with salt produced according to Example 15.

Referring to FIG. 43, the in-plane shows a result in which the magnetic characteristics were measured in the horizontal direction of the disc, and each value exhibited a saturated magnetization (Ms) of 59.436 emu/g, a residual magnetization (Mr) of 32.397 emu/g, and a coercive force (Hc) of 4954 Oe, and thus a Mr/Ms of 54.51% was exhibited.

The out-of-plane shows a result in which the magnetic characteristics were measured in the vertical direction of the disc, and each value exhibited a saturated magnetization (Ms) of 53.986 emu/g, a residual magnetization (Mr) of 30.634 emu/g, and a coercive force (Hc) of 5001 Oe, and thus a Mr/Ms of 56.74% was exhibited.

The Mr/Ms of 50% denotes that magnetic particles are not completely aligned, and the Mr/Ms of 100% denotes that magnetic particles are completely aligned. A value measured in the vertical direction of the disc was 56.74%, and thus exhibited a value slightly higher than that measured in the horizontal direction thereof.

Figure 44:
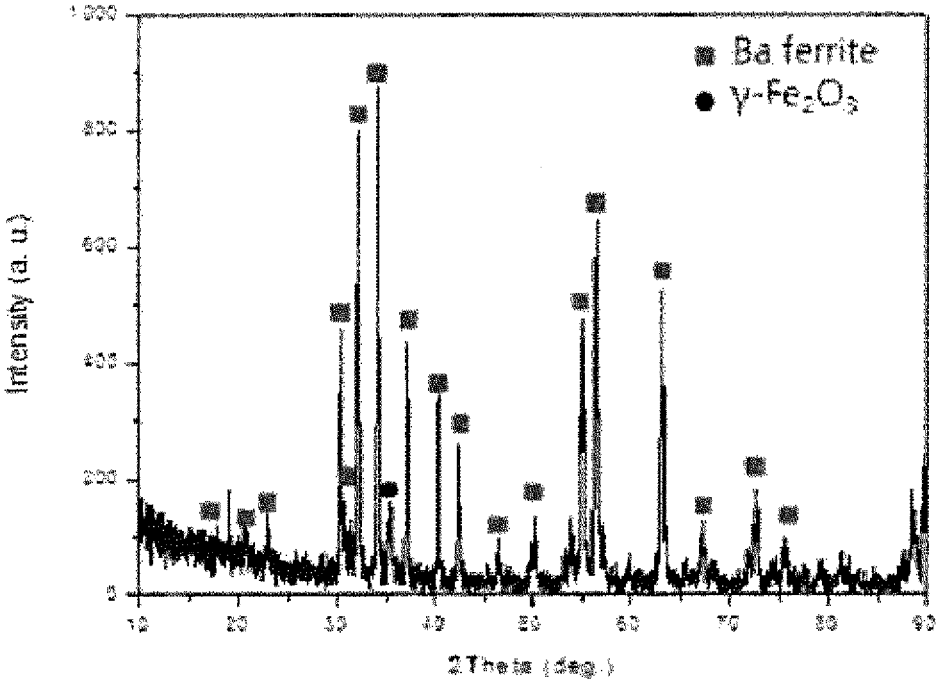
FIG. 44 is an X-ray diffraction graph for a sintered body (barium ferrite magnet with salt) produced according to Example 15.

FIG. 44 is an X-ray diffraction graph for a sintered body (barium ferrite magnet with salt) produced according to Example 15.

Referring to FIG. 44, barium ferrite phases were well formed, but $\gamma$-$Fe_2O_3$ phases that were not shown in the X-ray diffraction graph of barium ferrite magnetic powder with salt synthesized in Example 7 were shown. It is seen that barium ferrite inverse reaction occurred by a carbon component emerged from a carbon material mold (molding frame) used during the spark plasma sintering (SPS) process and barium ferrite on a surface of the molded body was decomposed into $\gamma$-$Fe_2O_3$.

Figure 45:
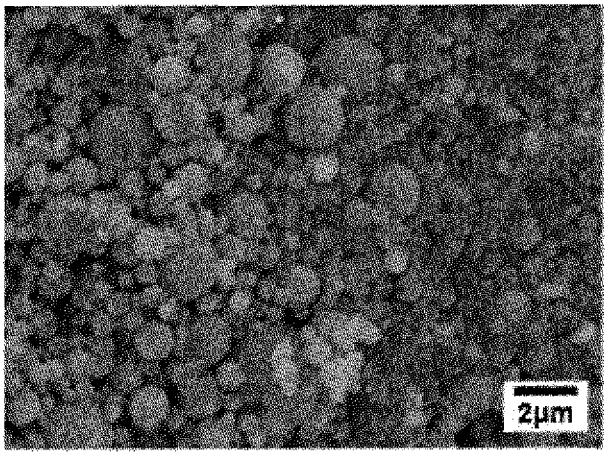
FIGS. 45 and 46 are scanning electron microscope (SEM) photos illustrating a fracture surface of a sintered body (barium ferrite magnet with salt) produced according to Example 15.
Figure 46:
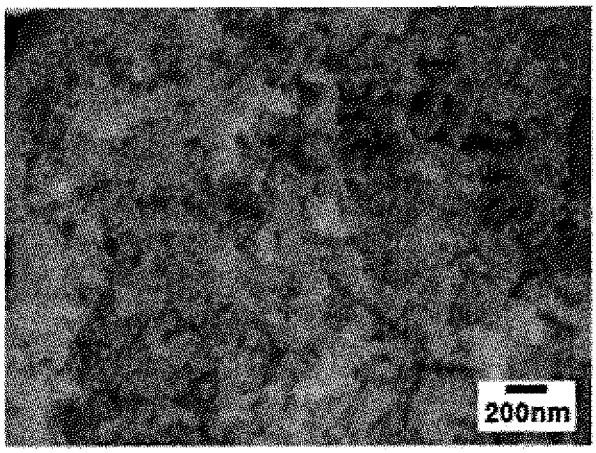

FIGS. 45 and 46 are scanning electron microscope (SEM) photos illustrating a fracture surface of a sintered body (barium ferrite magnet with salt) produced according to Example 15.

Referring to FIGS. 45 and 46, the form of magnetic particles maintained a spherical secondary particle shape as a whole, and a portion that had been partially molten was observed in the fracture surface image. The primary particles exhibited a size of approximately around 100 nm at a portion where the secondary particles were destroyed.

Example 16

Barium ferrite magnetic powder with salt synthesized according to Example 7 (in case where sodium chloride was added in a weight ratio of 5% with respect to barium ferrite magnetic powder with salt and synthesized at a temperature of 800° C.) was molded and sintered (with spark plasma sintering) to evaluate the magnetic characteristics using the formed sintered body (barium ferrite magnet with salt).

The molding and sintering conditions were as follows. Barium ferrite magnetic powder with salt synthesized according to Example 7 was filled into a molding frame with a carbon material and heated at a heating rate of 100° C. per minute to a target temperature of 800° C. under argon (Ar) atmosphere. The molding frame heated at 800° C. was maintained at a pressure of 100 MPa for two minutes and then cooled to obtain a sintered body (barium ferrite magnet with salt). The manufactured sintered body has a disc type, and was manufactured such that the height of the disc is greater than one half of the diameter thereof.

Figure 47:
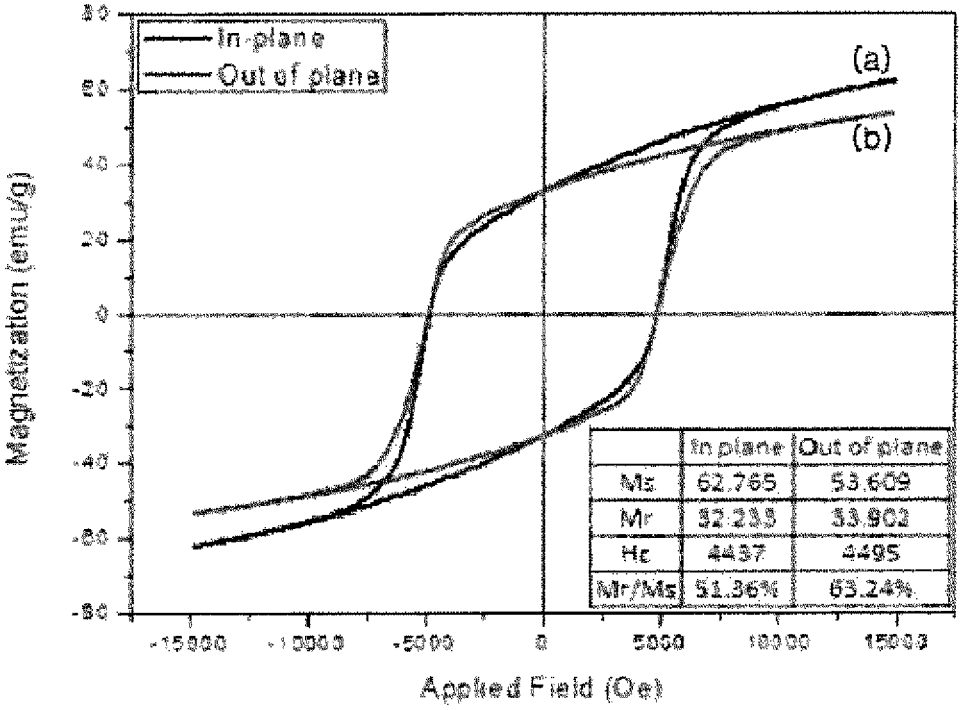
FIG. 47 is a graph in which magnetic characteristics are evaluated using a vibrating sample magnetometer (VSM) for a barium ferrite magnet with salt produced according to Example 16.

FIG. 47 is a graph in which magnetic characteristics are evaluated using a vibrating sample magnetometer (VSM) for a barium ferrite magnet with salt produced according to Example 16.

Referring to FIG. 47, the in-plane shows a result in which the magnetic characteristics were measured in the horizontal direction of the disc, and each value exhibited a saturated magnetization (Ms) of 62.765 emu/g, a residual magnetization (Mr) of 32.233 emu/g, and a coercive force (Hc) of 4437 Oe, and thus a Mr/Ms of 51.36% was exhibited.

The out-of-plane shows a result in which the magnetic characteristics were measured in the vertical direction of the disc, and each value exhibited a saturated magnetization (Ms) of 53.609 emu/g, a residual magnetization (Mr) of 33.902 emu/g, and a coercive force (Hc) of 4495 Oe, and thus a Mr/Ms of 63.24% was exhibited.

In case of a value measured in the vertical direction of the disc, it was 63.24%, and thus the Mr/Ms value was shown to be higher than that measured in the horizontal direction thereof. It denotes that the magnetization easy axis of barium ferrite was aligned in the vertical direction of the disc during the molding process.

Figure 48:
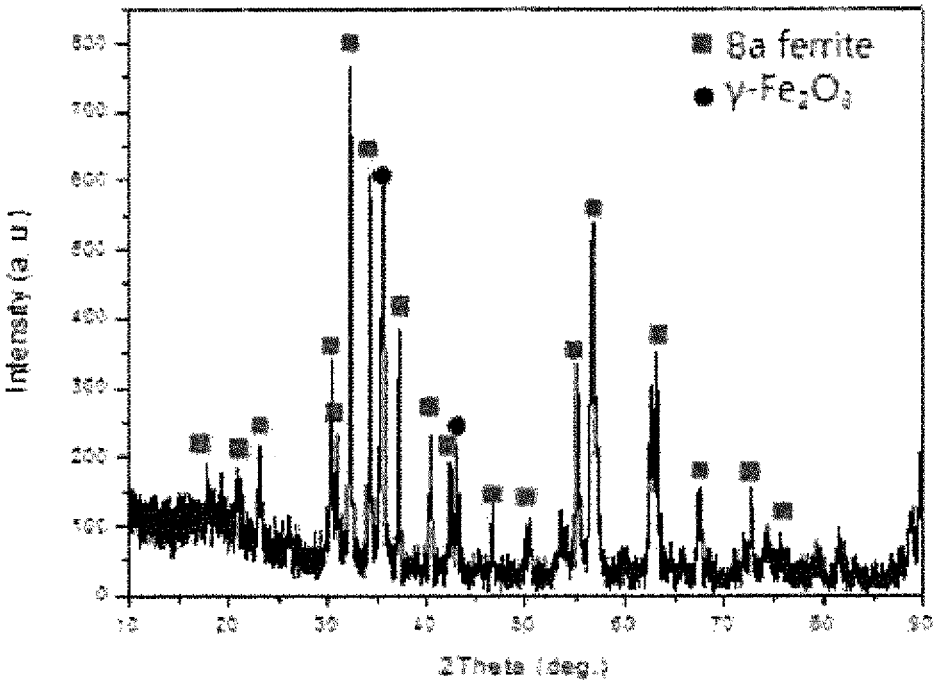
FIG. 48 is an X-ray diffraction graph for a sintered body (barium ferrite magnet with salt) produced according to Example 16.

FIG. 48 is an X-ray diffraction graph for a sintered body (barium ferrite magnet with salt) produced according to Example 16.

Referring to FIG. 48, barium ferrite phases were well formed, but $\gamma$-$Fe_2O_3$ phases that were not shown in the X-ray diffraction graph of barium ferrite magnetic powder with salt synthesized in Example 7 were shown.

Figure 49:
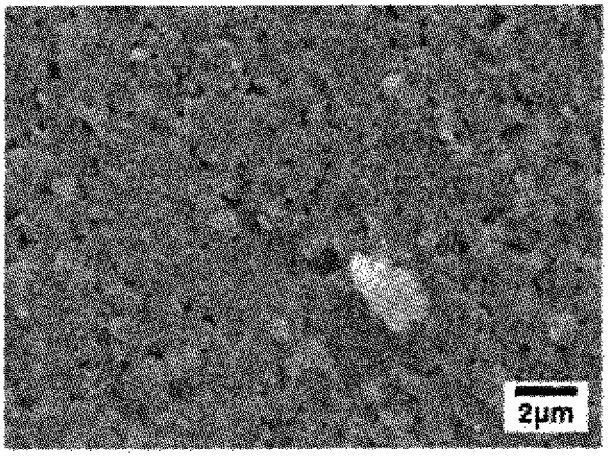
FIGS. 49 and 50 are scanning electron microscope (SEM) photos illustrating a fracture surface of a sintered body (barium ferrite magnet with salt) produced according to Example 16.
Figure 50:
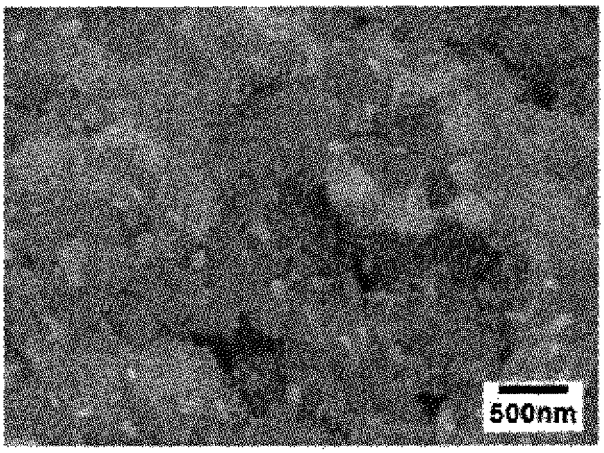

FIGS. 49 and 50 are scanning electron microscope (SEM) photos illustrating a fracture surface of a sintered body (barium ferrite magnet with salt) produced according to Example 16.

Referring to FIGS. 49 and 50, it was difficult to find an original spherical secondary particle shape as a whole, and observed that the added sodium chloride was well molten. It is supposed that relatively well molten salt was contributed to the alignment of barium ferrite particles, and thus expected to obtain a higher alignment level when optimizing conditions for manufacturing and sintering ferrite powder with molten salt.

Example 17

Barium ferrite magnetic powder with salt synthesized according to Example 10 (in case where potassium chloride was added in a weight ratio of 5% with respect to barium ferrite magnetic powder with salt and synthesized at a temperature of 800° C.) was molded and sintered (with spark plasma sintering) to evaluate the magnetic characteristics using the formed sintered body (barium ferrite magnet with salt).

The molding and sintering conditions were as follows. Barium ferrite magnetic powder with salt synthesized according to Example 10 was filled into a molding frame with a carbon material and heated at a heating rate of 100° C. per minute to a target temperature of 700° C. under argon (Ar) atmosphere. The molding frame heated at 700° C. was maintained at a pressure of 100 MPa for two minutes and then cooled to obtain a sintered body (barium ferrite magnet with salt). The manufactured sintered body has a disc type, and was manufactured such that the height of the disc is greater than one half of the diameter thereof.

Figure 51:
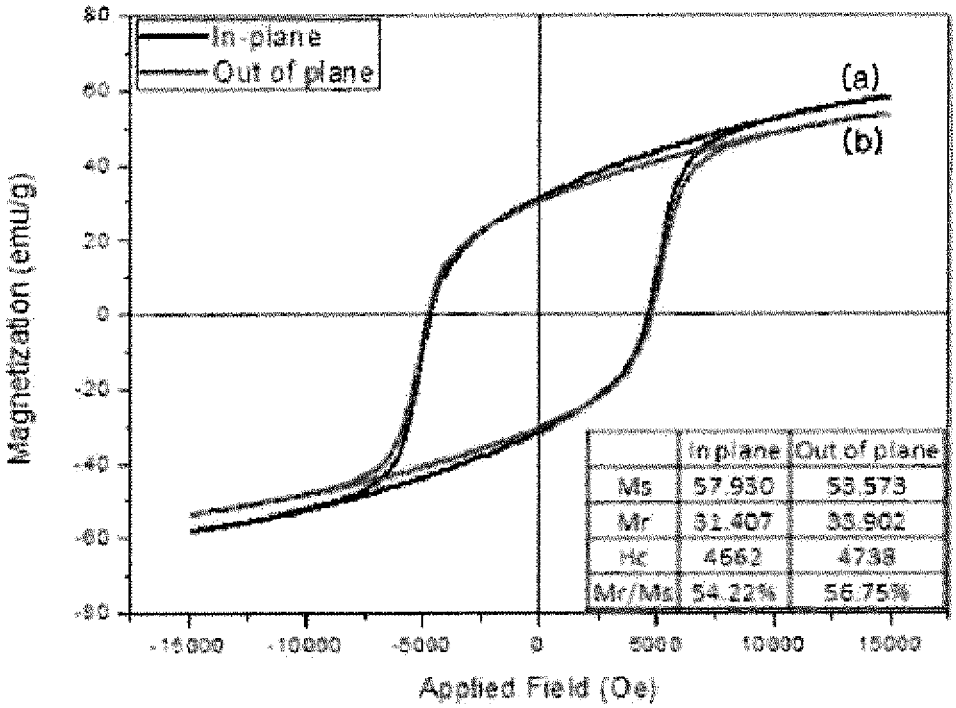
FIG. 51 is a graph in which magnetic characteristics are evaluated using a vibrating sample magnetometer (VSM) for a barium ferrite magnet with salt produced according to Example 17.

FIG. 51 is a graph in which magnetic characteristics are evaluated using a vibrating sample magnetometer (VSM) for a barium ferrite magnet with salt produced according to Example 17.

Referring to FIG. 51, the in-plane shows a result in which the magnetic characteristics were measured in the horizontal direction of the disc, and each value exhibited a saturated magnetization (Ms) of 57.930 emu/g, a residual magnetization (Mr) of 31.407 emu/g, and a coercive force (Hc) of 4662 Oe, and thus a Mr/Ms of 54.22% was exhibited.

The out-of-plane shows a result in which the magnetic characteristics were measured in the vertical direction of the disc, and each value exhibited a saturated magnetization (Ms) of 53.573 emu/g, a residual magnetization (Mr) of 33.902 emu/g, and a coercive force (Hc) of 4738 Oe, and thus a Mr/Ms of 56.75% was exhibited.

In case of a value measured in the vertical direction of the disc, it was 56.75%, and thus the Mr/Ms value was shown to be higher than that measured in the horizontal direction thereof.

Figure 52:
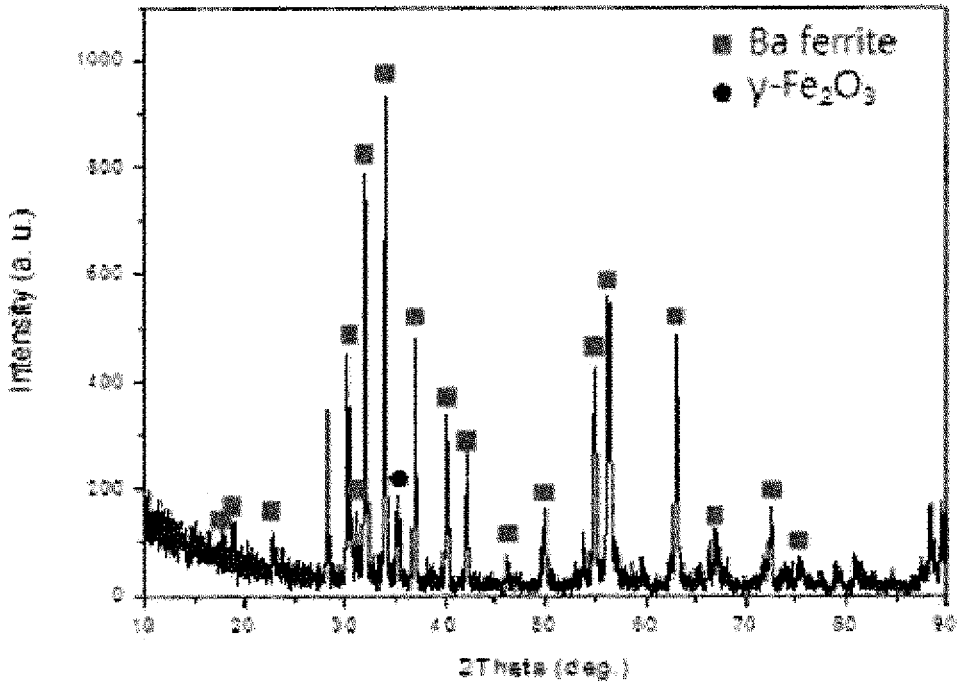
FIG. 52 is an X-ray diffraction graph for a sintered body (barium ferrite magnet with salt) produced according to Example 17.

FIG. 52 is an X-ray diffraction graph for a sintered body (barium ferrite magnet with salt) produced according to Example 17.

Referring to FIG. 52, it is seen that barium ferrite phases subsequent to molding and sintering were well formed whereas crystalline peaks for barium ferrite were not shown in Example 10. It is supposed that barium ferrite phases were formed due to heat and pressure during the molding and sintering processes. Furthermore, $\gamma$-$Fe_2O_3$ phases were also observed similarly to Examples 15 and 16.

Figure 53:
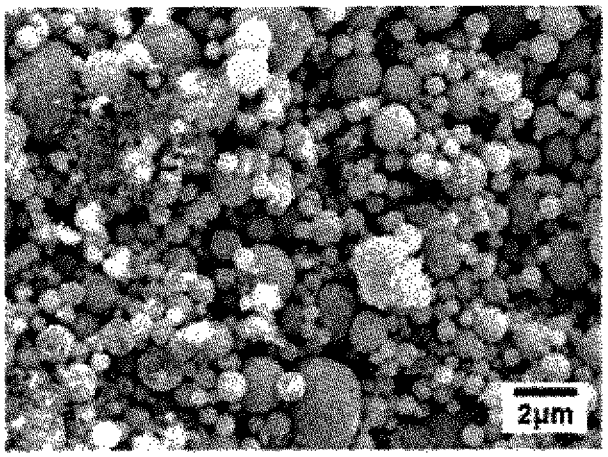
FIGS. 53 and 54 are scanning electron microscope (SEM) photos illustrating a fracture surface of a sintered body (barium ferrite magnet with salt) produced according to Example 17.
Figure 54:
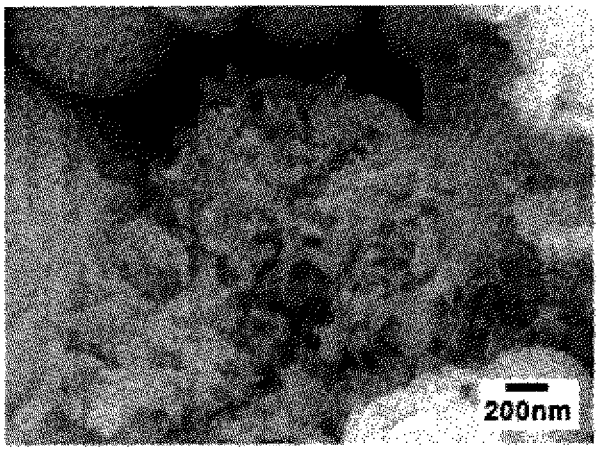

FIGS. 53 and 54 are scanning electron microscope (SEM) photos illustrating a fracture surface of a sintered body (barium ferrite magnet with salt) produced according to Example 17.

Referring to FIGS. 53 and 54, the form of magnetic particles maintained a spherical secondary particle shape as a whole and it was difficult to observe a molten portion. The primary particles that could not have been observed in Example 10 were observed in a size of approximately around 100 nm at a portion where the secondary particles were destroyed.

Example 18

Barium ferrite magnetic powder with salt synthesized according to Example 10 (in case where potassium chloride was added in a weight ratio of 5% with respect to barium ferrite magnetic powder with salt and synthesized at a temperature of 800° C.) was molded and sintered (with spark plasma sintering) to evaluate the magnetic characteristics using the formed sintered body (barium ferrite magnet with salt). The other molding conditions were similar to Example 17, and only the sintering temperature was increased to 800° C. for the experiment.

The molding and sintering conditions were as follows. Barium ferrite magnetic powder with salt synthesized according to Example 10 was filled into a molding frame with a carbon material and heated at a heating rate of 100° C. per minute to a target temperature of 800° C. under argon (Ar) atmosphere. The molding frame heated at 800° C. was maintained at a pressure of 100 MPa for two minutes and then cooled to obtain a sintered body (barium ferrite magnet with salt). The manufactured sintered body has a disc type, and was manufactured such that the height of the disc is greater than one half of the diameter thereof.

Figure 55:
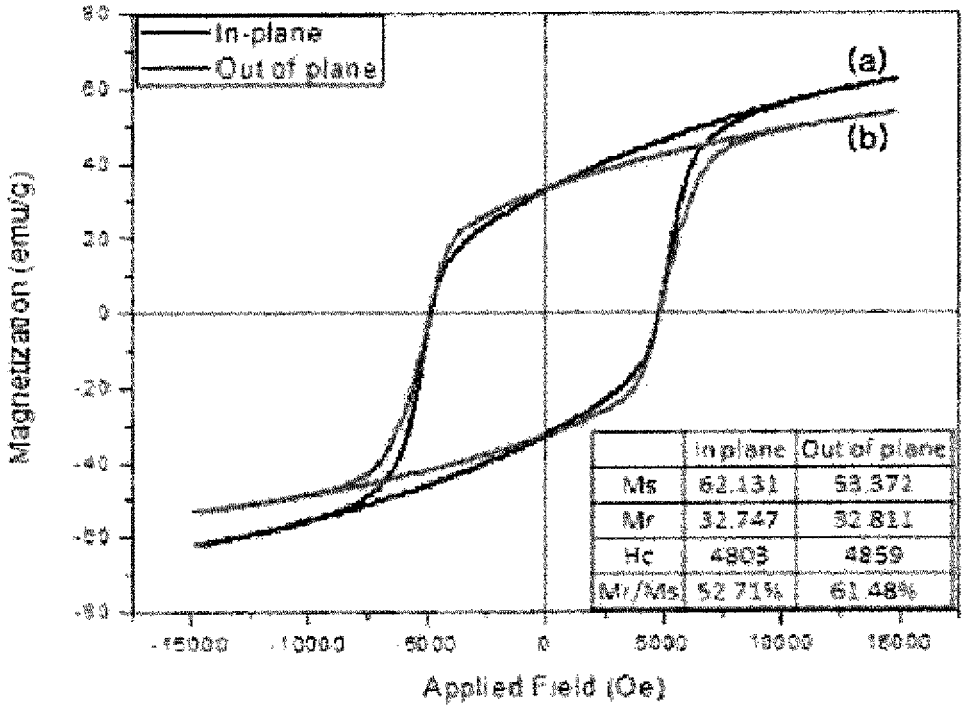
FIG. 55 is a graph in which magnetic characteristics are evaluated using a vibrating sample magnetometer (VSM) for a barium ferrite magnet with salt produced according to Example 18.

FIG. 55 is a graph in which magnetic characteristics are evaluated using a vibrating sample magnetometer (VSM) for a barium ferrite magnet with salt produced according to Example 18.

Referring to FIG. 55, the in-plane shows a result in which the magnetic characteristics were measured in the horizontal direction of the disc, and each value exhibited a saturated magnetization (Ms) of 62.131 emu/g, a residual magnetization (Mr) of 32.747 emu/g, and a coercive force (Hc) of 4803 Oe, and thus a Mr/Ms of 52.71% was exhibited.

The out-of-plane shows a result in which the magnetic characteristics were measured in the vertical direction of the disc, and each value exhibited a saturated magnetization (Ms) of 53.372 emu/g, a residual magnetization (Mr) of 32.811 emu/g, and a coercive force (Hc) of 4859 Oe, and thus a Mr/Ms of 61.48% was exhibited.

In case of a value measured in the vertical direction of the disc, it was 61.48%, and thus the Mr/Ms value was shown to be higher than that measured in the horizontal direction thereof. It denotes that the alignment of barium ferrite particles occurred in the direction of the magnetization easy axis in the vertical direction of the disc.

Figure 56:
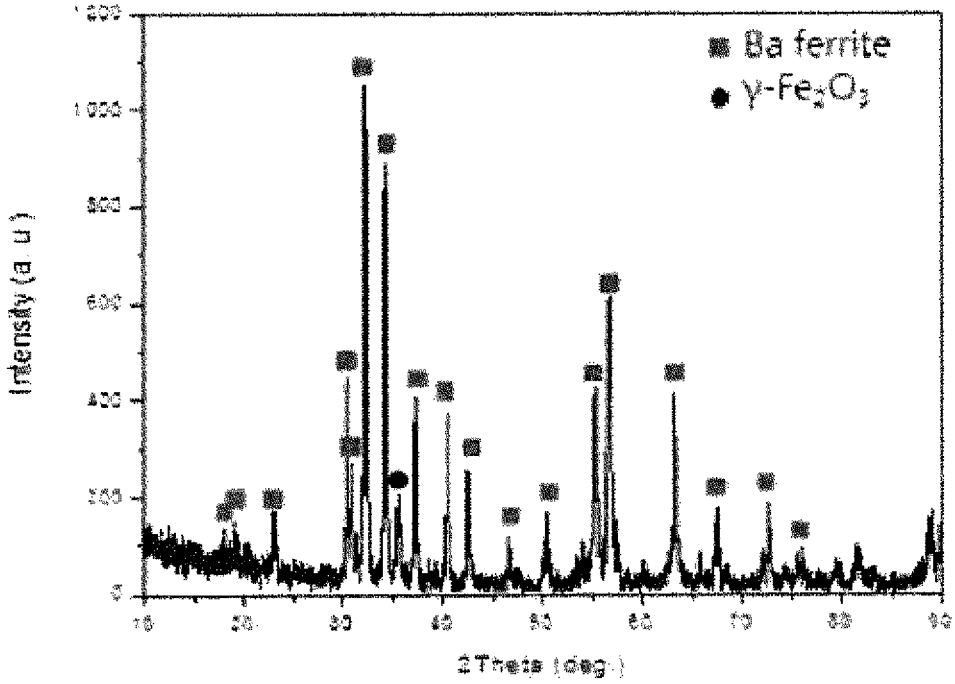
FIG. 56 is an X-ray diffraction graph for a sintered body (barium ferrite magnet with salt) produced according to Example 18.

FIG. 56 is an X-ray diffraction graph for a sintered body (barium ferrite magnet with salt) produced according to Example 18.

Referring to FIG. 56, it is seen that barium ferrite phases subsequent to molding and sintering were well formed whereas crystalline peaks for barium ferrite were not shown in Example 10. It is supposed that barium ferrite phases were formed due to heat and pressure during the molding and sintering processes. Furthermore, $Fe_2O_3$ phases due to a carbon inverse reaction were also observed similarly to Examples 15 through 17.

Figure 57:
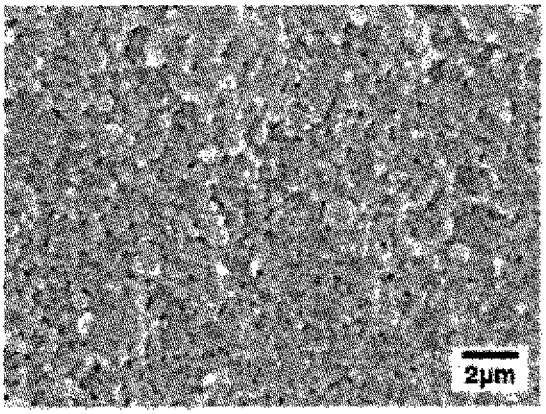
FIGS. 57 and 58 are scanning electron microscope (SEM) photos illustrating a fracture surface of a sintered body (barium ferrite magnet with salt) produced according to Example 18.
Figure 58:
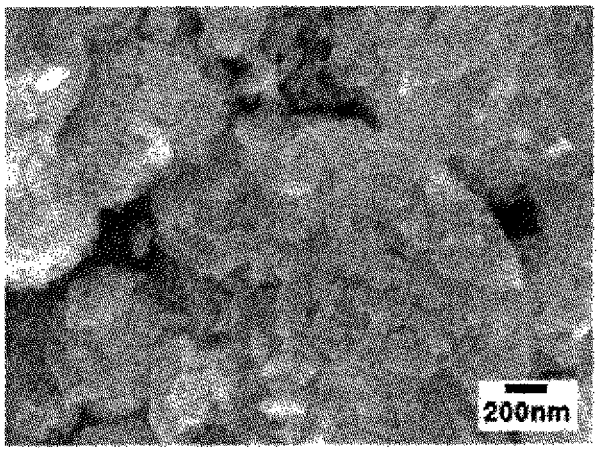

FIGS. 57 and 58 are scanning electron microscope (SEM) photos illustrating a fracture surface of a sintered body (barium ferrite magnet with salt) produced according to Example 18.

Referring to FIGS. 57 and 58, the melting of the added potassium chloride is progressed into a medium state that the boundary surface of particles is being disappeared and thus it is seen that potassium chloride is not completely molten. It is observed that melting was carried out to some extent within a fracture surface.

Example 19

Barium ferrite magnetic powder with salt synthesized according to Example 13 (in case where sodium chloride was added in a weight ratio of 5% with respect to barium ferrite magnetic powder with salt and synthesized at an inlet temperature of 250° C., and an outlet temperature of 850° C.) was molded and sintered (with spark plasma sintering) to evaluate the magnetic characteristics using the formed sintered body (barium ferrite magnet with salt).

The molding and sintering conditions were as follows. Barium ferrite magnetic powder with salt synthesized according to Example 13 was filled into a molding frame with a carbon material and heated at a heating rate of 100° C. per minute to a target temperature of 800° C. under argon (Ar) atmosphere. The molding frame heated at 800° C. was maintained at a pressure of 100 MPa for five minutes and then cooled to obtain a sintered body (barium ferrite magnet with salt). The manufactured sintered body has a disc type, and was manufactured such that the height of the disc is greater than one half of the diameter thereof.

Figure 59:
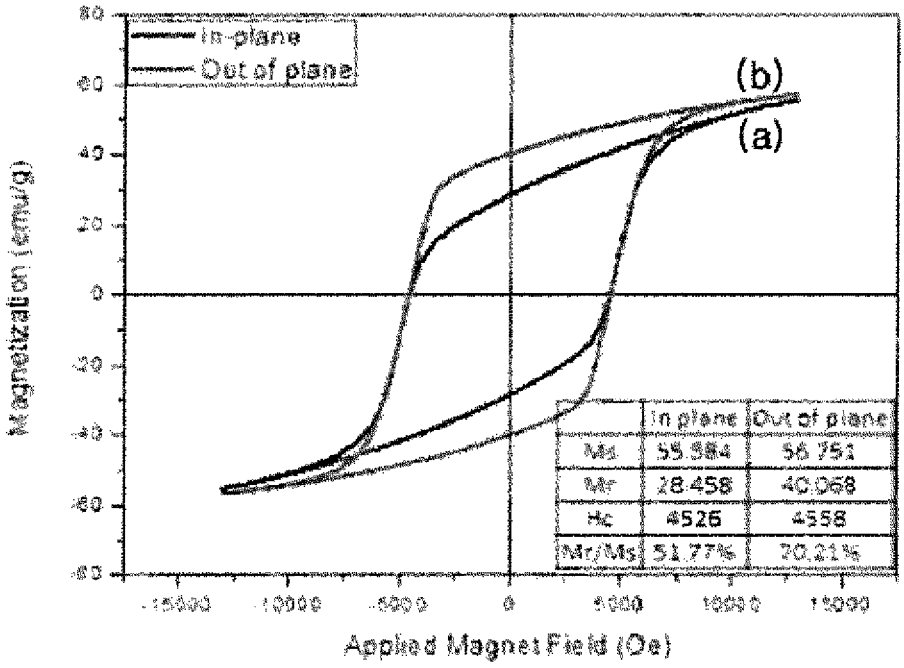
FIG. 59 is a graph in which magnetic characteristics are evaluated using a vibrating sample magnetometer (VSM) for a barium ferrite magnet with salt produced according to Example 19.

FIG. 59 is a graph in which magnetic characteristics are evaluated using a vibrating sample magnetometer (VSM) for a barium ferrite magnet with salt produced according to Example 19.

Referring to FIG. 59, the in-plane shows a result in which the magnetic characteristics were measured in the horizontal direction of the disc, and each value exhibited a saturated magnetization (Ms) of 55.384 emu/g, a residual magnetization (Mr) of 28.458 emu/g, and a coercive force (Hc) of 4526 Oe, and thus a Mr/Ms of 51.77% was exhibited.

The out-of-plane shows a result in which the magnetic characteristics were measured in the vertical direction of the disc, and each value exhibited a saturated magnetization (Ms) of 56.751 emu/g, a residual magnetization (Mr) of 40.068 emu/g, and a coercive force (Hc) of 4558 Oe, and thus a Mr/Ms of 70.21% was exhibited.

In case of a value measured in the vertical direction of the disc, it was 70.21%, and thus the Mr/Ms value was shown to be higher than that measured in the horizontal direction thereof. It denotes that the magnetization easy axis of barium ferrite was aligned in the vertical direction of the disc during the molding process.

Figure 60:
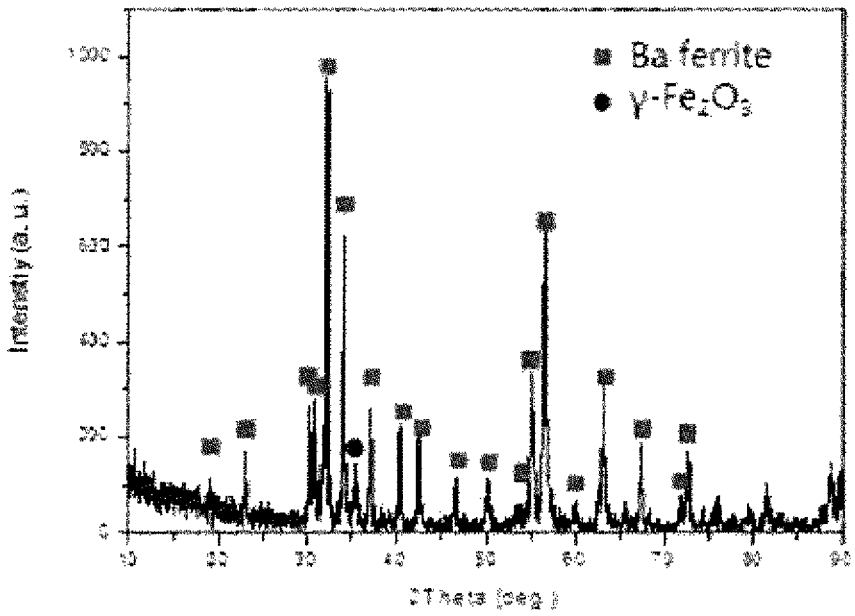
FIG. 60 is an X-ray diffraction graph for a sintered body (barium ferrite magnet with salt) produced according to Example 19.

FIG. 60 is an X-ray diffraction graph for a sintered body (barium ferrite magnet with salt) produced according to Example 19.

Referring to FIG. 60, it is seen that barium ferrite phases subsequent to molding and sintering were well formed whereas crystalline peaks for barium ferrite were not shown in Example 13. It is supposed that barium ferrite phases were formed due to heat and pressure during the molding and sintering processes.

Figure 61:
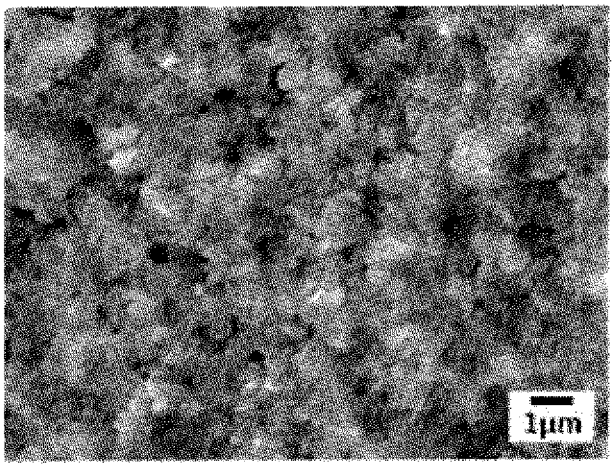
FIGS. 61 and 62 are scanning electron microscope (SEM) photos illustrating a fracture surface of a sintered body (barium ferrite magnet with salt) produced according to Example 19.
Figure 62:
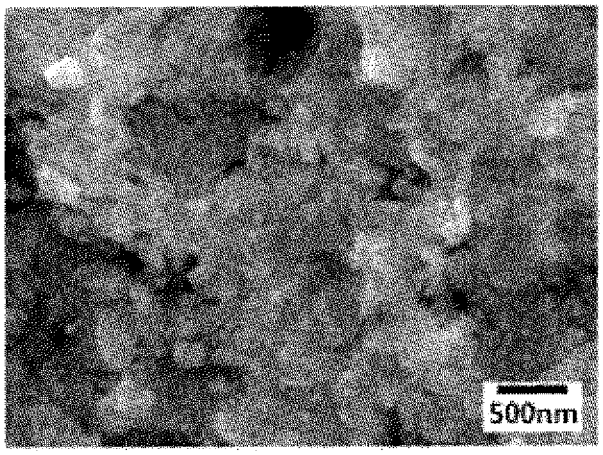

FIGS. 61 and 62 are scanning electron microscope (SEM) photos illustrating a fracture surface of a sintered body (barium ferrite magnet with salt) produced according to Example 19.

Referring to FIGS. 61 and 62, it was difficult to find an original spherical secondary particle shape as a whole, and observed that the added sodium chloride was well molten. It is supposed that relatively well molten salt was contributed to the alignment of barium ferrite particles, and thus expected to obtain a higher alignment level when optimizing conditions for manufacturing and sintering ferrite powder with molten salt.

Example 20

Barium ferrite magnetic powder with salt synthesized according to Example 14 (in case where sodium chloride was added in a weight ratio of 3% with respect to barium ferrite magnetic powder with salt and synthesized at an inlet temperature of 250° C., and an outlet temperature of 850° C.) was molded and sintered (with spark plasma sintering) to evaluate the magnetic characteristics using the formed sintered body (barium ferrite magnet with salt).

The molding and sintering conditions were as follows. Barium ferrite magnetic powder with salt synthesized according to Example 14 was filled into a molding frame with a carbon material and heated at a heating rate of 100° C. per minute to a target temperature of 800° C. under argon (Ar) atmosphere. The molding frame heated at 800° C. was maintained at a pressure of 100 MPa for five minutes and then cooled to obtain a sintered body (barium ferrite magnet with salt). The manufactured sintered body has a disc type, and was manufactured such that the height of the disc is greater than one half of the diameter thereof.

Figure 63:
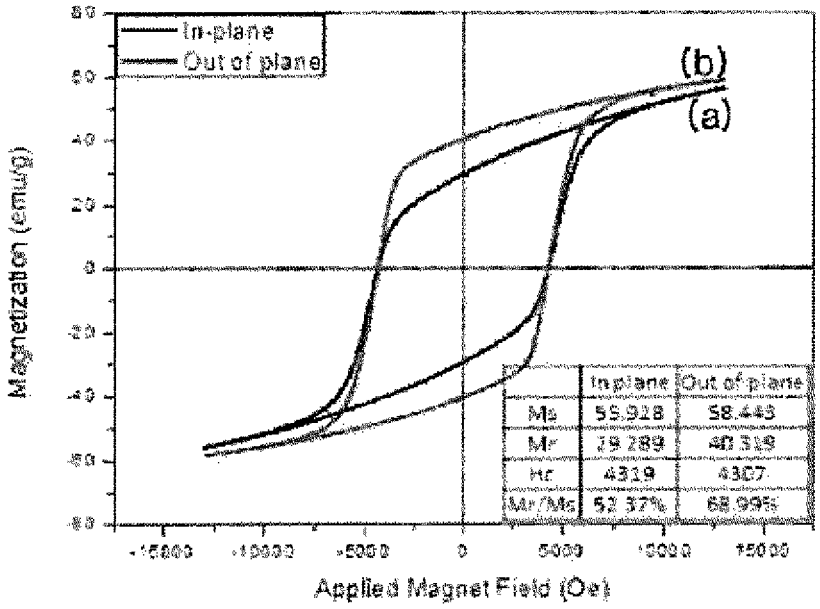
FIG. 63 is a graph in which magnetic characteristics are evaluated using a vibrating sample magnetometer (VSM) for a barium ferrite magnet with salt produced according to Example 20.

FIG. 63 is a graph in which magnetic characteristics are evaluated using a vibrating sample magnetometer (VSM) for a barium ferrite magnet with salt produced according to Example 20.

Referring to FIG. 63, the in-plane shows a result in which the magnetic characteristics were measured in the horizontal direction of the disc, and each value exhibited a saturated magnetization (Ms) of 55.928 emu/g, a residual magnetization (Mr) of 29.289 emu/g, and a coercive force (Hc) of 4319 Oe, and thus a Mr/Ms of 52.37% was exhibited.

The out-of-plane shows a result in which the magnetic characteristics were measured in the vertical direction of the disc, and each value exhibited a saturated magnetization (Ms) of 58.443 emu/g, a residual magnetization (Mr) of 40.319 emu/g, and a coercive force (Hc) of 4307 Oe, and thus a Mr/Ms of 68.99% was exhibited.

In case of a value measured in the vertical direction of the disc, it was 68.99%, and thus the Mr/Ms value was shown to be higher than that measured in the horizontal direction thereof. It denotes that the magnetization easy axis of barium ferrite was aligned in the vertical direction of the disc during the molding process.

Figure 64:
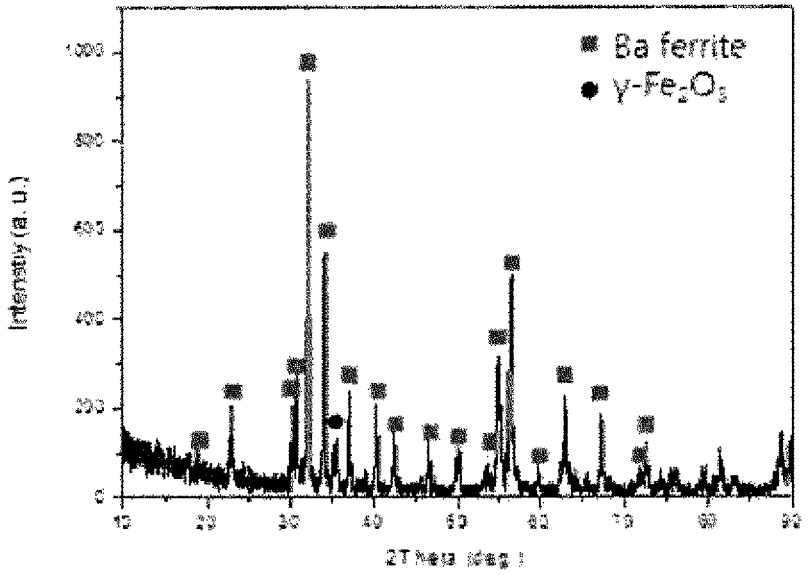
FIG. 64 is an X-ray diffraction graph for a sintered body (barium ferrite magnet with salt) produced according to Example 20.

FIG. 64 is an X-ray diffraction graph for a sintered body (barium ferrite magnet with salt) produced according to Example 20.

Referring to FIG. 64, it is seen that barium ferrite phases subsequent to molding and sintering were well formed whereas crystalline peaks for barium ferrite were not shown in Example 14. It is supposed that barium ferrite phases were formed due to heat and pressure during the molding and sintering processes.

Figure 65:
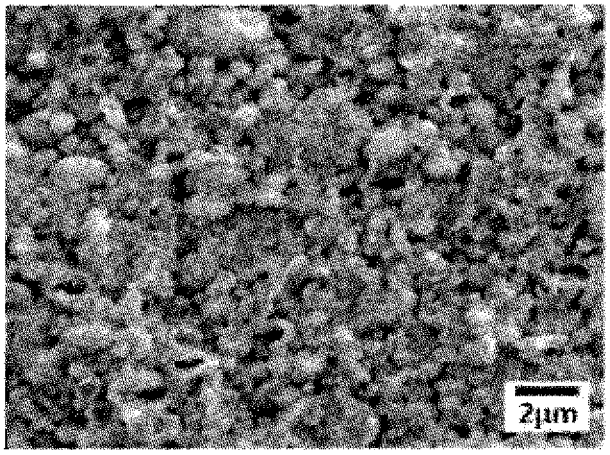
FIGS. 65 and 66 are scanning electron microscope (SEM) photos illustrating a fracture surface of a sintered body (barium ferrite magnet with salt) produced according to Example 20.
Figure 66:
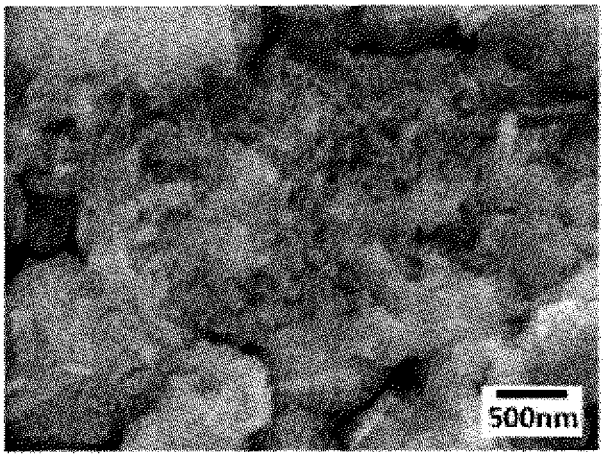

FIGS. 65 and 66 are scanning electron microscope (SEM) photos illustrating a fracture surface of a sintered body (barium ferrite magnet with salt) produced according to Example 20.

Referring to FIGS. 65 and 66, molten portions and non-molten portions were exhibited in a mixed manner and it is supposed to be a phenomenon that occurred due to a low content of molten salt compared to Example 19 with the same sintering condition. However, a relatively high Mr/Ms value (68.99%) was exhibited and thus it is expected to obtain a higher alignment level when optimizing conditions for manufacturing and sintering ferrite powder with molten salt.

Samples formed with incomplete ferrite phases during the process of synthesizing ferrite magnetic powder with salt may be also applicable since they exhibited ferrite phases during the sintering process as disclosed in Examples 17 through 20.

As described above, although exemplary embodiments have been described in detail, the present invention is not limited to the foregoing embodiments, and it will be apparent to those skilled in this art that the present invention may be implemented in various other forms within the scope of the technical concept of the present invention.

What is claimed is:

1. A ferrite sintered magnet with salt obtained by molding and sintering ferrite magnetic powders into a desired form, comprising:

40 to 99.9 weight % of ferrite and 0.1 to 60 weight % of salt, wherein the salt has a melting point lower than a synthetic temperature of the ferrite, the salt forms a salt matrix between the ferrite particles, the ferrite sintered magnet with salt has a structure in which a plurality of ferrites are uniformly dispersed in the salt matrix, and the ferrite magnetic powders are secondary particles each of which is composed of a plurality of primary particles mixed with salt.

2. The ferrite sintered magnet with salt of claim 1, wherein the secondary particles are spherical particles having a diameter of 0.1 to 20 μm or non-spherical particles having a diameter of 0.1 to 1000 μm, and the primary particles have a diameter of 5 to 1000 nm.

3. The ferrite sintered magnet with salt of claim 1, wherein the ferrite sintered magnet with salt has a ratio (Mr/Ms) of residual magnetization (Mr) to saturated magnetization (Ms) greater than 50%.

4. The ferrite sintered magnet with salt of claim 1, wherein the salt comprises at least one or more selected from a chloride metal salt, a nitric acid metal salt, and a sulfuric acid metal salt, and the chloride metal salt is one or more selected from NaCl, KCl, LiCl, $CaCl_2$ and $MgCl_2$, and the nitric acid metal salt is one or more selected from $NaNO_3$, $KNO_3$, $LiNO_3$, $Ca(NO_3)_2$ and $Mg(NO_3)_2$, and the sulfuric acid metal salt is one or more selected from $Na_2SO_4$, $K_2SO_4$, $Li_2SO_4$, $CaSO_4$ and $MgSO_4$.

5. The ferrite sintered magnet with salt of claim 1, wherein the ferrite is a hexagonal ferrite, the hexagonal ferrite has a form of $MFe_{12}O_{19}$, and the M comprises one or more selected from Ba, Sr and La.

6. The ferrite sintered magnet with salt of claim 1, wherein the ferrite is a spinel ferrite, the spinel ferrite has a form of $MFe_2O_4$ or $M_2FeO_4$, and the M is one or more selected from Co, Mg, Mn, Zn and Ni.

7. A method of manufacturing a ferrite sintered magnet with salt, the method comprising:

preparing a source material of the ferrite to be synthesized;

preparing a salt having a melting point lower than a synthetic temperature of the ferrite to be synthesized;

mixing the source material of the ferrite with the salt;

synthesizing ferrite magnetic powders with salt while melting the salt by an aerosol spray pyrolysis method; and molding and sintering the ferrite magnetic powders with salt into a desired form to obtain a ferrite sintered magnet with salt, wherein the ferrite sintered magnet with salt comprises 40 to 99.9 weight % of ferrite and 0.1 to 60 weight % of salt, and the salt forms a salt matrix between the ferrite particles.

8. The method of claim 7, wherein the salt uses a salt having a melting point lower than the temperature of synthesizing the ferrite magnetic powders with salt, and the sintering is carried out in a temperature condition of melting the salt or a temperature and pressure condition of melting the salt.

9. The method of claim 7, wherein the ferrite sintered magnet with salt has a structure in which a plurality of ferrites are uniformly dispersed in the salt matrix, and the ferrite magnetic powders with salt are secondary particles each of which is composed of a plurality of primary particles mixed with salt.

10. The method of claim 9, wherein the secondary particles are spherical particles having a diameter of 0.1 to 20 μm or non-spherical particles having a diameter of 0.1 to 1000 μm, and the primary particles have a diameter of 5 to 1000 nm.

11. The method claim 7, wherein the ferrite sintered magnet with salt has a ratio (Mr/Ms) of residual magnetization (Mr) to saturated magnetization (Ms) greater than 50%.

12. The method of claim 7, wherein the salt comprises at least one or more selected from a chloride metal salt, a nitric acid metal salt, and a sulfuric acid metal salt, the chloride metal salt is one or more selected from NaCl, KCl, LiCl, $CaCl_2$ and $MgCl_2$, the nitric acid metal salt is one or more selected from $NaNO_3$, $KNO_3$, $LiNO_3$, $Ca(NO_3)_2$ and $Mg(NO_3)_2$, and the sulfuric acid metal salt is one or more kinds selected from $Na_2SO_4$, $K_2SO_4$, $Li_2SO_4$, $CaSO_4$ and $MgSO_4$.

13. The method of claim 7, wherein the source material of the ferrite comprises one or more selected from $Ba(NO_3)_2$, $BaCO_3$, $BaCl_2$, $BaSO_4$, $BaO_2$, $Sr(NO_3)_2$, $SrCO_3$, $SrCl_2$, $SrSO_4$, $Sr(OH)_2La(NO_3)_3$, $LaCl_3$, $La_2(SO_4)_3$ and $La(OH)_3$, and one or more kinds of materials selected from $Fe(NO_3)_3$, $FeCO_3$, $FeCl_3$, $Fe_2O_3$, $FeCl_2$, and $Fe(OH)_3$, the ferrite is a hexagonal ferrite, the hexagonal ferrite has a form of $MFe_{12}O_{19}$, and the M comprises one or more selected from Ba, Sr, Co and La.

14. The method of claim 7, wherein the source material of the ferrite comprises one or more selected from $Fe(NO_3)_3$, $FeCO_3$, $FeCl_3$, $Fe_2O_3$, $FeCl_2$, $Fe(OH)_3$, $Co(NO_3)_2$, $CoCO_3$, $CoCl_2$, $CoSO_4$, $Mn(NO_3)_2$, $MnCO_3$, $MnCl_2$, $MnSO_4$, $MnO_2$, $Mg(NO_3)_2$, $MgCO_3$, $MgCl_2$, $MgSO_4$, $Ni(NO_3)_2$, $NiCO_3$, $NiCl_2$, $NiSO_4$, $Zn(NO_3)_2$, $ZnCl_2$, $ZnSO_4$ and ZnO, and the ferrite is a spinel ferrite, and the spinel ferrite has a form of $MFe_2O_4$ or $M_2FeO_4$ and the M is one or more selected from Co, Mg, Mn, Zn and Ni.

15. The method of claim 7, wherein the source material of the ferrite comprises one or more selected from $Ba(NO_3)_2$, $BaCO_3$, $BaCl_2$, $BaSO_4$, $BaO_2$, $Sr(NO_3)_2$, $SrCO_3$, $SrCl_2$, $SrSO_4$, $Sr(OH)_2La(NO_3)_3$, $LaCl_3$, $La_2(SO_4)_3$ and $La(OH)_3$, and one or more kinds of materials selected from $Fe(NO_3)_3$, $FeCO_3$, $FeCl_3$, $Fe_2O_3$, $FeCl_2$, and $Fe(OH)_3$, and wherein said synthesizing the ferrite magnetic powders with salt is carried out by the aerosol spray pyrolysis method which comprises:

supplying power to a heating means surrounding the circumference of a reaction chamber in a spray pyrolysis apparatus and heating the reaction chamber to maintain a temperature higher than the melting point of the salt in a consistent manner;

supplying a carrier gas to a sprayer containing a mixture of the source material of the ferrite and the salt;

vibrating the mixture contained in the sprayer by an ultrasonic transducer to generate liquid droplets in the sprayer; and introducing the liquid droplets into the reaction chamber by the carrier gas and allowing the liquid droplets introduced into the reaction chamber to be subjected to the pyrolysis and oxidation reaction to synthesize ferrite magnetic powders with salt.

* * * * *